US010494144B2

(12) United States Patent
Weiss et al.

(10) Patent No.: US 10,494,144 B2
(45) Date of Patent: Dec. 3, 2019

(54) SOCK GROUPING AND USER IDENTIFICATION DEVICE

(71) Applicant: John H. Weiss, Orland Park, IL (US)

(72) Inventors: Angela Weiss, Orland Park, IL (US); John H. Weiss, Orland Park, IL (US)

( * ) Notice: Subject to any disclaimer, the term of this patent is extended or adjusted under 35 U.S.C. 154(b) by 204 days.

(21) Appl. No.: 15/460,632

(22) Filed: Mar. 16, 2017

(65) Prior Publication Data

US 2018/0022507 A1 Jan. 25, 2018

Related U.S. Application Data

(60) Provisional application No. 62/366,047, filed on Jul. 24, 2016.

(51) Int. Cl.
*B65D 25/04* (2006.01)
*B65D 43/16* (2006.01)
*B65D 85/18* (2006.01)

(52) U.S. Cl.
CPC ..... *B65D 25/04* (2013.01); *B65D 43/163* (2013.01); *B65D 85/18* (2013.01)

(58) Field of Classification Search
CPC ..... B65D 25/04; B65D 43/163; B65D 85/18; A45C 3/12
USPC ..... 206/281, 278, 282; 220/23.4, 254.3, 220/495.09, 523, 524, 533; 312/211, 213, 312/290
See application file for complete search history.

(56) References Cited

U.S. PATENT DOCUMENTS 3,958,715 A * 5/1976 Capelli ..... B65D 25/00 220/532
5,873,643 A * 2/1999 Burgess, Jr. ..... A47B 77/18 220/495.09
D670,059 S * 10/2012 Katechis ..... D34/9
8,544,673 B1 * 10/2013 Polk ..... B65F 1/004 220/212.5
8,844,741 B2 * 9/2014 Perelli ..... B65F 1/0053 220/23.4
8,950,113 B1 * 2/2015 Schall ..... B65D 19/18 220/533
9,051,083 B1 * 6/2015 Davis ..... B65D 25/06
9,051,119 B2 * 6/2015 Jarrett ..... B65F 1/0046
9,289,083 B2 * 3/2016 Lee ..... A47G 19/30
9,545,297 B1 * 1/2017 Krastev ..... A61J 1/00
(Continued)

*Primary Examiner* — Sue A Weaver
(74) *Attorney, Agent, or Firm* — Donald Flaynik

(57) ABSTRACT

A device for grouping socks in accordance with the present invention includes a container having a plurality of ridge walls integrally joined to inner side and inner end walls of the container. The ridge walls form channels on the inner side and inner end walls of the container. The device further includes one or more chamber walls removably inserted into selected channels in the container. The one or more chamber walls form at least two sock receiving chambers with each chamber having a chamber cover. Each of the chamber covers has an aperture to allow selected socks to be disposed in a selected sock receiving chamber when the selected chamber cover is in a closed position. Each of the chamber covers has an identification marking on a top surface of each of the chamber covers. The identification marking can include, but not limited to children names, sock sizes, sock lengths, sock colors and a myriad of other group identifiers.

20 Claims, 40 Drawing Sheets

(56) References Cited

U.S. PATENT DOCUMENTS

2012/0164283 A1* 6/2012 Kissner ..... B65D 43/169
426/112
2018/0100265 A1* 4/2018 Gang ..... D03D 1/00

* cited by examiner

F.IG. 5

33
33
212
212
210
212
212
210
210
210

202
204
206
208
204
206
208
204
206
208

SOCK GROUPING AND USER IDENTIFICATION DEVICE

This Utility Application is based on U.S. Provisional Application No. 62/366,047, filed on Jul. 24, 2016.

BACKGROUND OF THE INVENTION

1. Field of the Invention

The present invention relates generally to cloth storage containers, and more particularly, to a sock storage device having chambers that store predetermined groups of socks with the socks in each chamber identified to be worn by a particular person.

2. Background of the Prior Art

When retrieving washed and dried socks from a drying machine, a person will combine pairs of socks, and deposit the pairs of socks into a basket, whereupon, the socks are carried to a place of storage where another person ultimate searches for a pair of socks in the container that they can wear.

To save time and prevent duplicated work, a container is needed that includes separate chambers for receiving socks owned by a person whose name is placed on a top wall of a cover for the sock chamber dedicated to that one person. Pairs of socks are quickly disposed into a respective sock chamber by manually inserting each pair of socks through an aperture in a selected closed chamber cover and into the chamber dedicated to the person named on the cover. The sock receiving chamber is quickly opened by the person named on the cover and a pair of socks owned by the named person is selected and worn.

SUMMARY OF THE INVENTION

It is a principal object of the present invention is to provide a sock grouping and user identification device. A feature of the device is plurality of ridge walls integrally joined to inner side walls of a container. Another feature of the device is the insertion of chamber walls into ridge channels formed by two ridge walls vertically and integrally joined to the inner side walls of the container. An advantage of the device is that a myriad of configurations and quantities of sock receiving chambers can be formed in a container. The quantity of sock receiving chambers correspond to a predetermined number of persons, each person identified with a dedicated sock receiving chamber that groups predetermined socks for use by the person identified upon a top wall of a cover for the dedicated chamber.

Another object of the present invention is to provide a sock grouping and user identification device that inexpensively provides a predetermined quantity of sock receiving chambers. A feature of the device is lateral and longitudinal chamber walls that can be manually inserted into the ridge channels formed by two ridge walls. Another feature of the device is that the lateral and longitudinal walls include vertical joining slots that enable the lateral and longitudinal walls to be slidably and manually joined together. An advantage of the device is that a user of the device can assemble lateral and longitudinal walls, or just lateral walls, or just longitudinal walls to provide a predetermined quantity of sock receiving chambers having dimensions that allow respective sock receiving chambers to group together a predetermined quantity of socks dedicated to be worn by only one person.

Still another object of the present invention is to provide a sock grouping and user identification device that provides covers for the sock receiving chambers. A feature of the device is a cover with a central aperture for each sock receiving chamber. Another feature of the device is that the cover is identified with only one person. Yet another feature is of the device is that the cover is closed or in a position that covers the sock receiving chamber when clean socks are being sorted and grouped by manually disposing a pair of socks identified to be worn by the person named on the top wall of the closed cover. An advantage of the device is that the aperture in the cover and the name on the closed cover, promotes easy grouping of a pair of clean socks into a sock receiving chamber dedicated to the person whose name appears on the top wall of the cover. Another advantage of the device is that the cover is relatively easy to manually pivot from a closed to an open position when a person reaches into the chamber to retrieve and wear a pair of socks disposed in the chamber having that person's name on the cover.

Yet another object of the present invention is to provide a sock grouping and user identification device that provides relatively inexpensive and quick attachment between a sock chamber cover and a top edge portion of a longitudinal chamber wall. A feature of the device is an elevated pivot rod secured to a top edge portion of the longitudinal chamber wall via a plurality of elevating ribs having a constant dimension of separation between adjacent elevating ribs. Another feature of the device is a plurality of chamber cover pivot members having arucate channels that pivotally grasp and remain secured to the pivot rod between adjacent elevating ribs, such that when the chamber cover is pivoted to an open position, an arcuate end portion of each arcuate channel pivots about and under the pivot rod until the chamber cover is in a retained open position.

BRIEF DESCRIPTION OF THE DRAWINGS

The foregoing invention and its advantages may be readily appreciated from the following Detailed description of the preferred embodiment, when read in conjunction with the accompanying drawings in which.

DESCRIPTION OF THE PREFERRED EMBODIMENT

Figure 1:
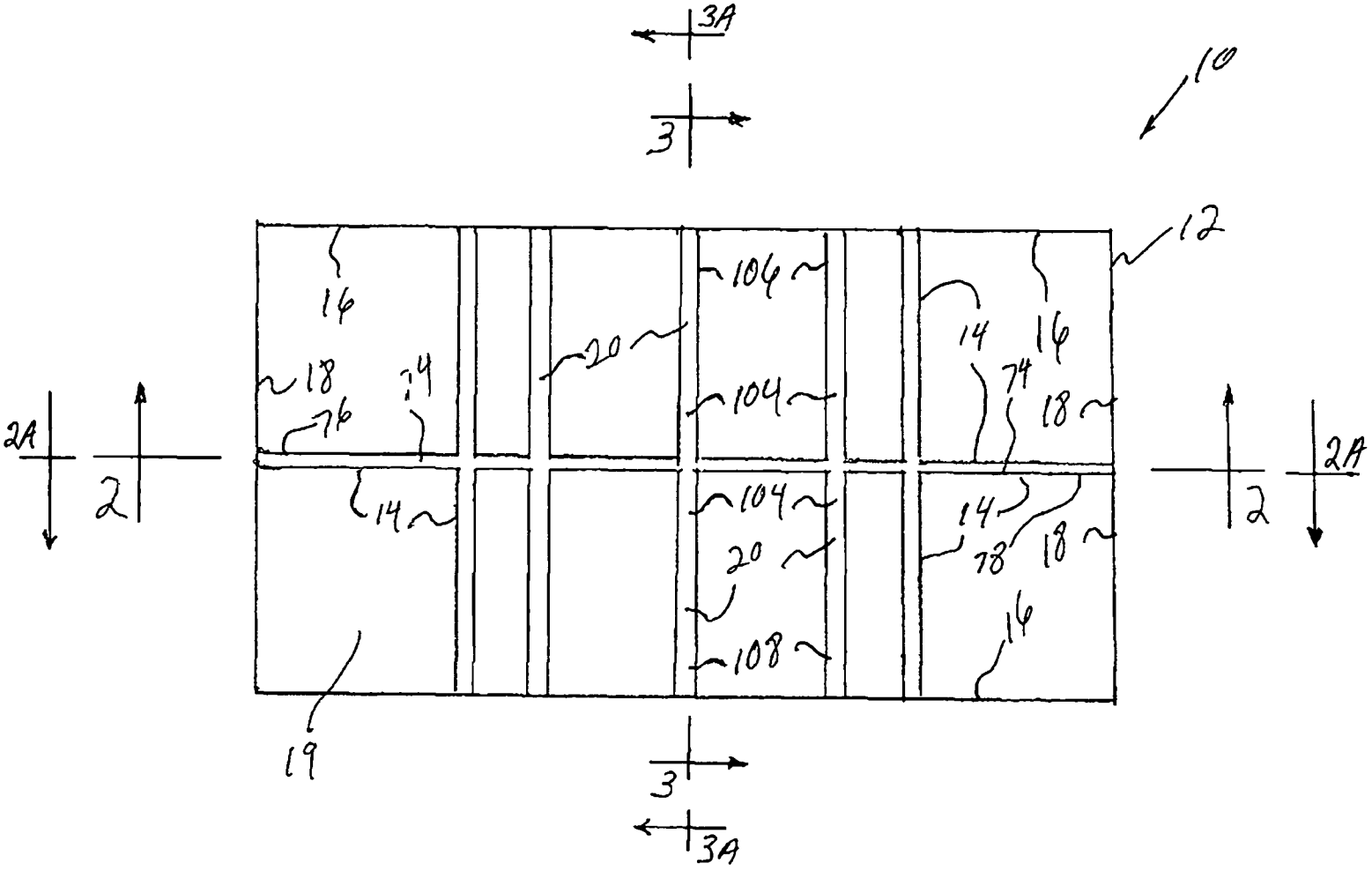
FIG. 1 is a top elevation view of a device for grouping socks, the device being depicted with channels and without covers in accordance with the present invention.

Referring now to the drawings, a device for grouping socks in accordance with the present invention is denoted as numeral 10. The device 10 includes a container 12 fabricated from plastic or similar rigid material and having a plurality of ridge walls 14 integrally joined to inner side and end walls 16 and 18, and a bottom wall 19 of the container 12. The ridge walls 14 form channels 20 on the inner side, end and bottom walls 16, 18 and 19 of the container 12. The device 10 further includes one or more chamber walls 22 removably inserted into selected channels 20 in the container 12. The one or more chamber walls 22 form at least two sock receiving chambers 24 with each chamber 24 having a chamber cover 26. Each of the chamber covers 26 has an aperture 28 to allow selected socks (not depicted) to be disposed in a selected sock receiving chamber 24 when the selected chamber cover 26 is in a closed position. Each of the chamber covers 26 has an identification marking (not depicted) on a top surface 30 of each of the chamber covers 26. The identification marking can include, but not limited to children names, sock sizes, sock lengths, sock colors and a myriad of other group identifiers. The chamber covers 26 also include a handle (not depicted) for enabling a person to manually pivot a chamber cover 26 from a closed position to an open position.

The chamber covers 26 are fabricated from plastic or similar rigid material and are pivotally secured to upper edge portions 32 of the container 12 by hinges 34 or similar pivoting members. The hinges 34 include a first element 36 secured to an edge portion 38 of a top surface 40 of a respective chamber cover 26. The hinges 34 also include a second element 42 secured to the upper edge portion 32 of an outer vertical wall 44 of the container 12. Alternatively, the second element 42 of the hinges 34 can be secured to an upper edge portion 32 of an inner side wall 16 of the container 12. The hinges 34 enable each of the chamber covers 26 to be independently pivoted from the closed position to an open position that forms an angle between the chamber covers 26 and the top edge portions 110 of the chamber walls 22 that maintains the chamber covers 26 in an open position, irrespective of a person releasing the chamber cover 26 to remove socks disposed in the sock chambers 24. The independent operation of the chamber covers 26 promotes the manual removal of the socks in a selected sock receiving chamber 24 after a corresponding chamber cover 26 for the selected sock receiving chamber 24 is disposed in an open position. Alternatively, the chamber covers 26 can remain unattached to the container 12, thereby allowing a user to totally separate the chamber covers 26 from the container when removing socks from the sock chambers 24.

Figure 3:
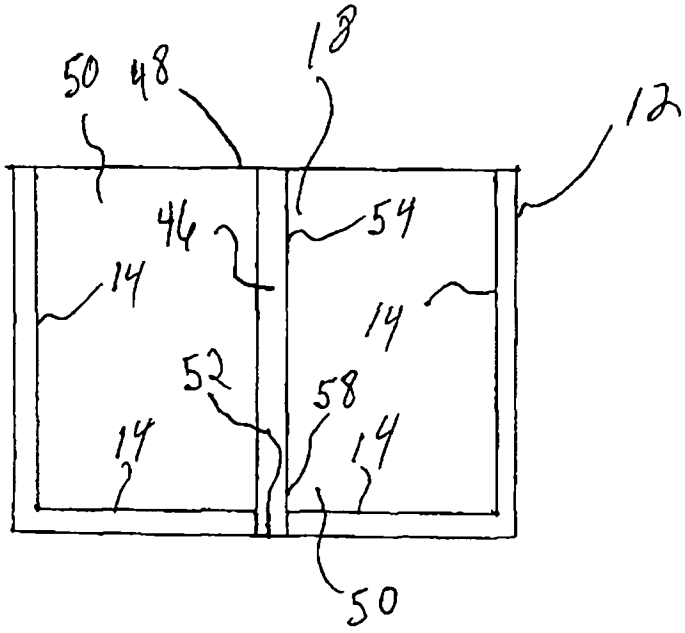
FIG. 3 is a sectional view taken along line 3-3 of FIG. 1.

Referring to FIG. 3, the ridge walls 14 form a substantially vertical first channel 46 extending from a top edge 48 of a first end wall 50 to a bottom edge 52 of the first end wall 50. One or more first channels 46 can be continuous or sectioned with an upper portion 54 disposed adjacent to the top edge 48 of the first end wall 50 and a lower portion 58 disposed adjacent to the bottom edge 52 of the first end wall 50.

Figure 3A:
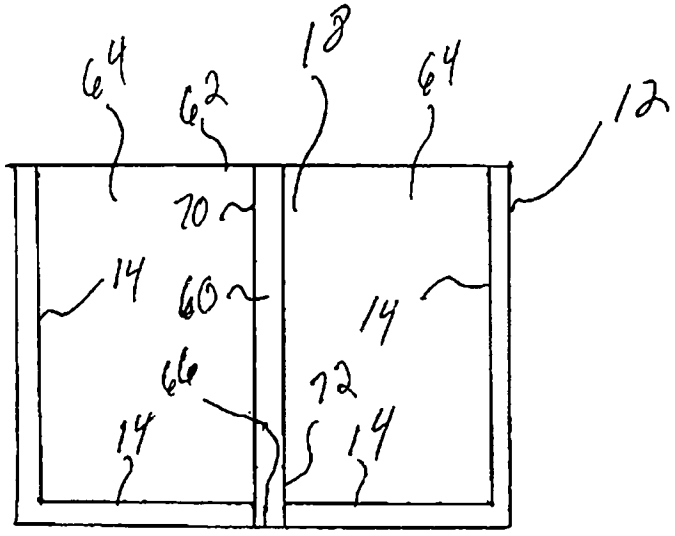
FIG. 3A is a sectional view taken along line 3A-3A of FIG. 1.
Figure 4:
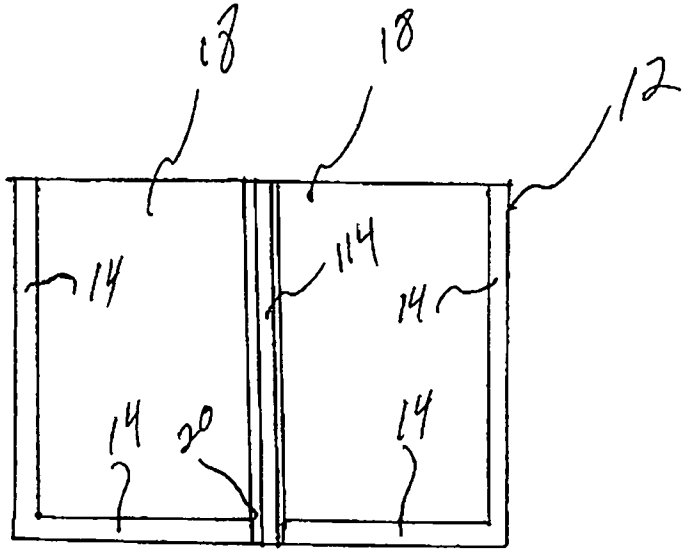
FIG. 4 is the sectional view of FIG. 3, but with a longitudinal chamber wall inserted in a channel.

Referring to FIG. 3A, the ridge walls 14 form a substantially vertical second channel 60 extending from a top edge 62 of a second end wall 64 to a bottom edge 66 of the second end wall 64. One or more second channels 60 can be continuous or sectioned with an upper portion 70 disposed adjacent to a top edge 62 of the second end wall 64 and a lower portion 72 disposed adjacent to the bottom edge 66 of the second end wall 64.

Referring to FIGS. 1, 3 and 3A, the ridge walls 14 form a substantially horizontal third channel 74 extending from the bottom edge 52 of the first end wall 50 to the bottom edge 66 of the second end wall 64. One or more third channels 74 can be continuous or sectioned with a first portion 76 adjacent to the bottom edge 52 of the first end wall 50 and a second portion 78 adjacent to the bottom edge 66 of the second end wall 64.

Figure 2:
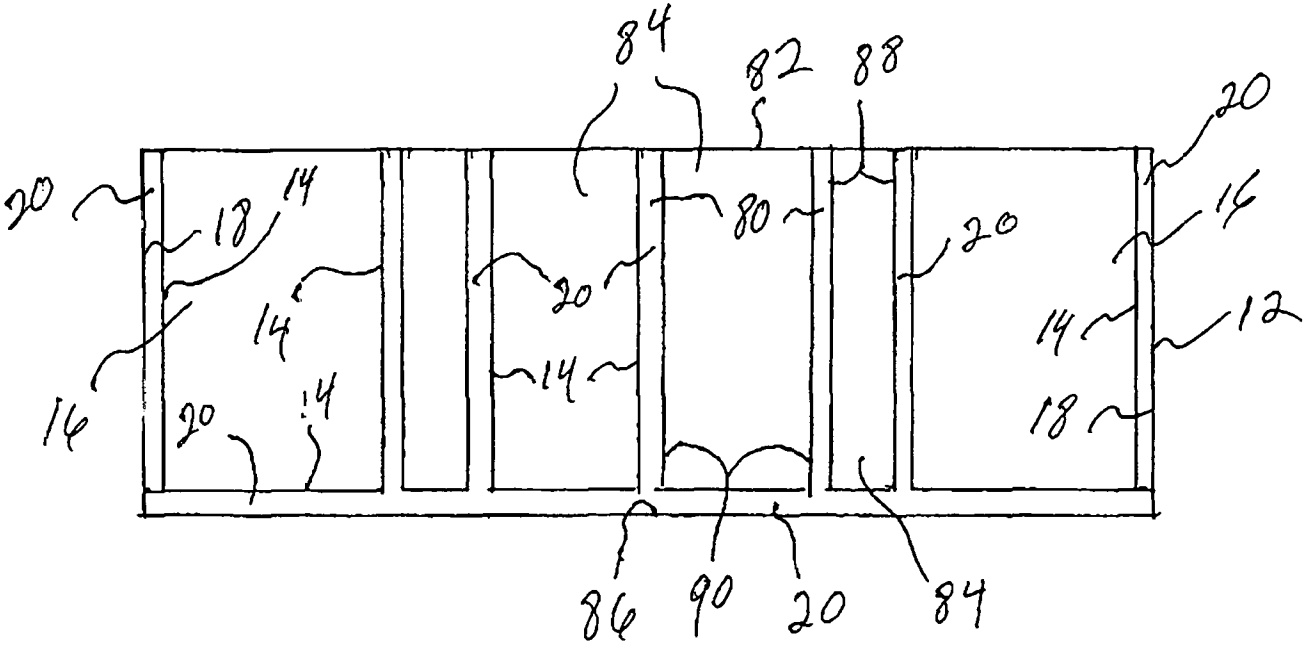
FIG. 2 is a sectional view taken along line 2-2 of FIG. 1.

Referring to FIG. 2, the ridge walls 14 form a substantially vertical fourth channel 80 extending from a top edge 82 of a first side wall 84 to a bottom edge 86 of the first side wall 84. One or more fourth channels 80 can be continuous or sectioned with an upper portion 88 disposed adjacent to the top edge 82 of the first end wall 84 and a lower portion 90 disposed adjacent to the bottom edge 86 of the first side wall 84.

Figure 2A:
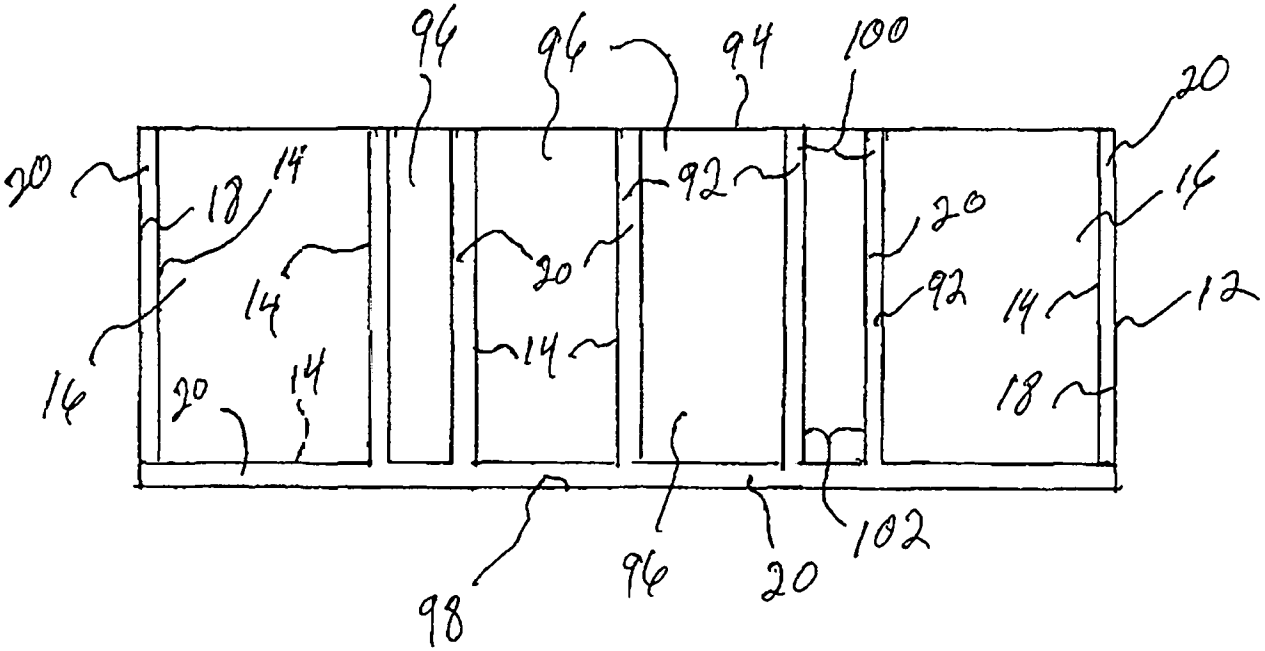
FIG. 2A is a sectional view taken along line 2A-2A of FIG. 1.

Referring to FIG. 2A, the ridge walls 14 form a substantially vertical fifth channel 92 extending from a top edge 94 of a second side wall 96 to a bottom edge 98 of the second side wall 96. One or more fifth channels 92 can be continuous or sectioned with an upper portion 100 disposed adjacent to the top edge 94 of the second side wall 96 and a lower portion 102 disposed adjacent to the bottom edge 98 of the second side wall 96.

Referring to FIGS. 1, 2 and 2A, the ridge walls 14 form a substantially horizontal sixth channel 104 extending from the bottom edge 86 of the first side wall 84 to the bottom edge 98 of the second side wall 96. One or more sixth channels 104 can be continuous or sectioned with a first portion 106 adjacent to the bottom edge 86 of the first side wall 84 and a second portion 108 adjacent to the bottom edge 86 of the second side wall 96.

Figure 5:
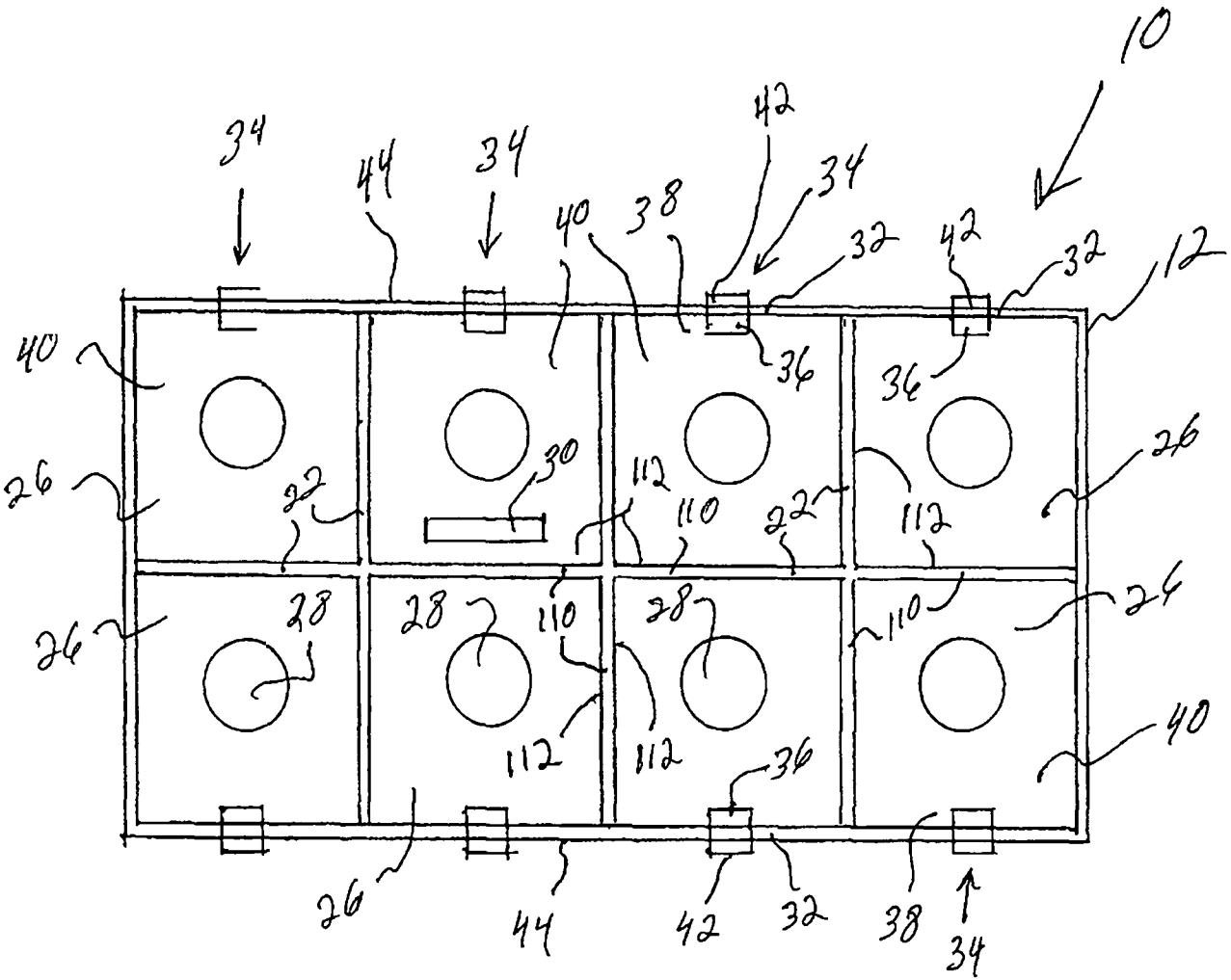
FIG. 5 is a top elevation view of device (with covers) for grouping socks in accordance with the present invention.
Figure 6:
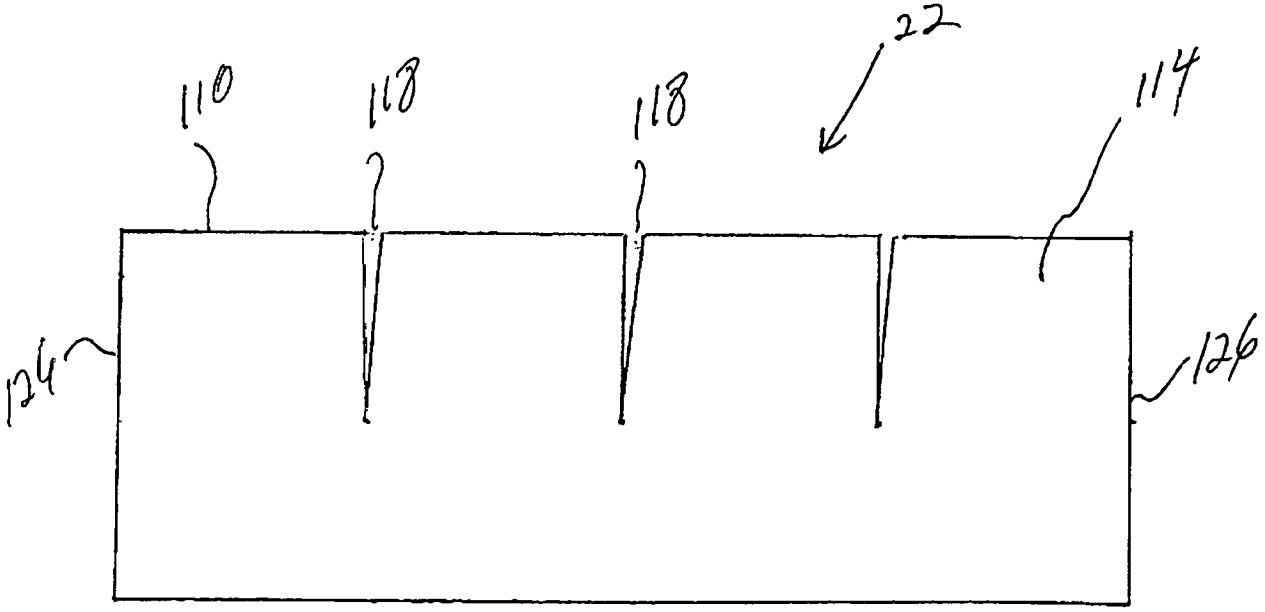
FIG. 6 is a front elevation view of a longitudinal chamber wall with upper recesses in accordance with the present invention.
Figure 7:
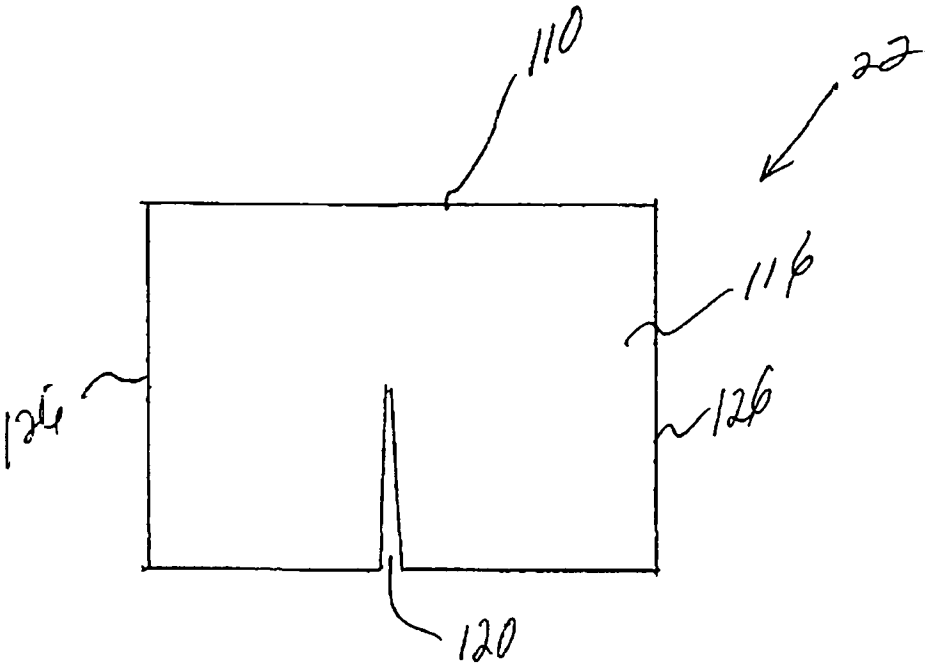
FIG. 7 is a front elevation view of a lateral chamber wall with a lower recess in accordance with the present invention.
Figure 8:
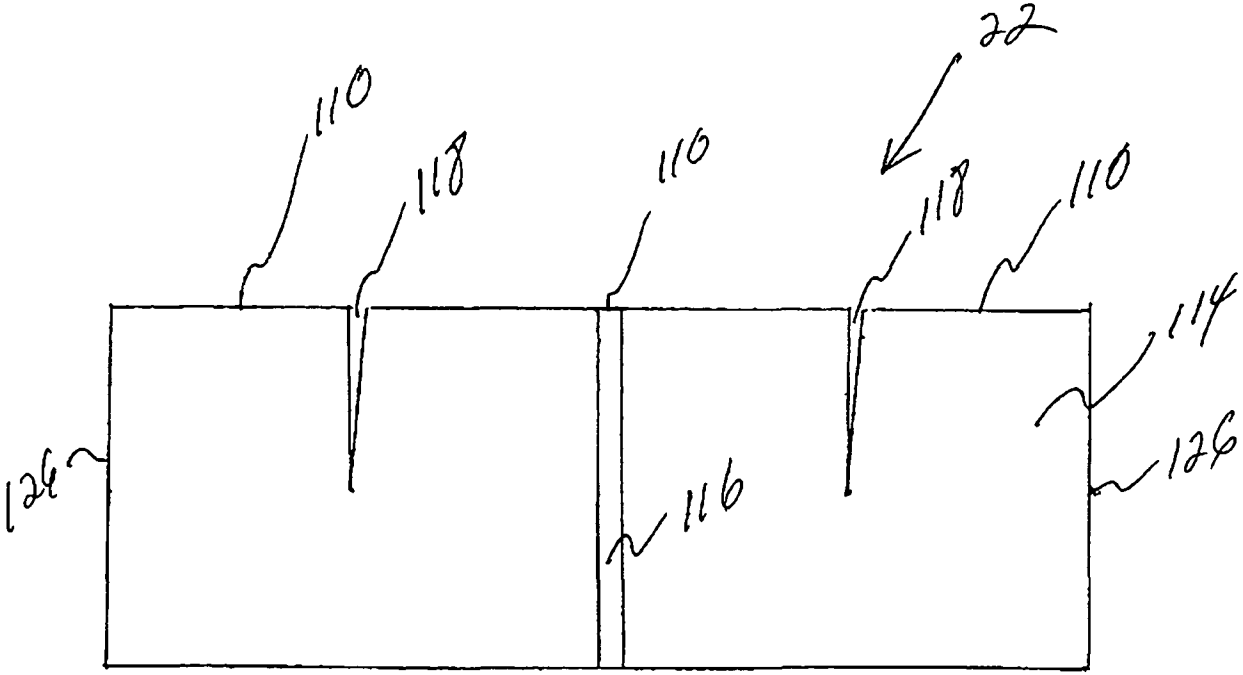
FIG. 8 is a front elevation view of a longitudinal chamber wall with a lateral chamber wall inserted upon the longitudinal chamber wall.
Figure 9:
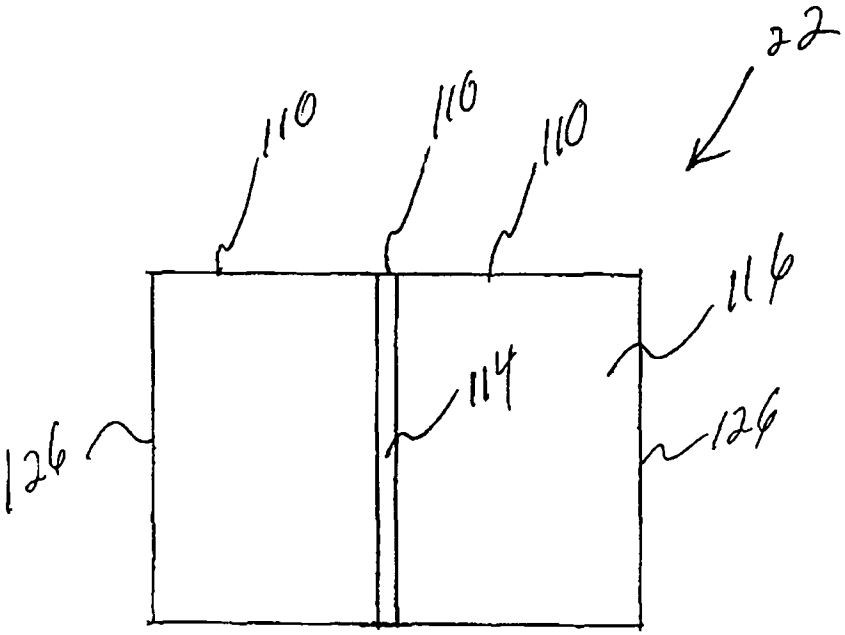
FIG. 9 is a front elevation view of a lateral chamber wall with the wall inserted upon a longitudinal chamber wall.
Figure 10:
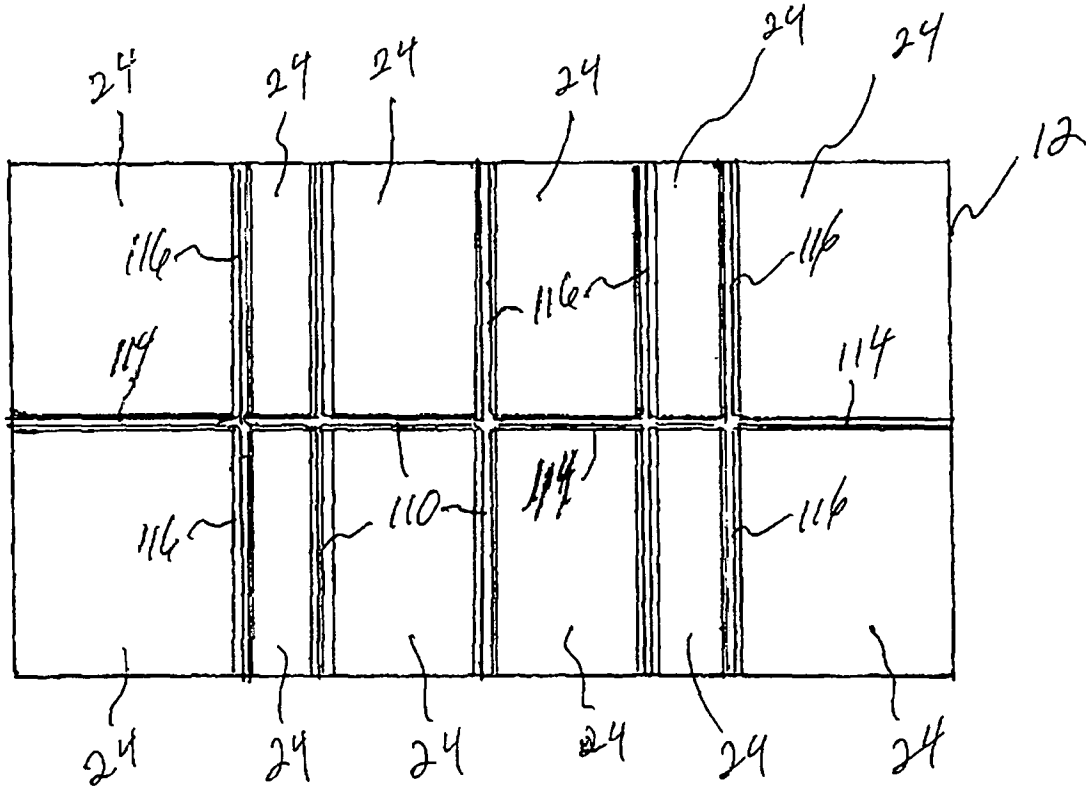
FIG. 10 is the top elevation view of FIG. 1, but with longitudinal and lateral chamber walls inserted in all channels in accordance with the present invention.
Figure 11:
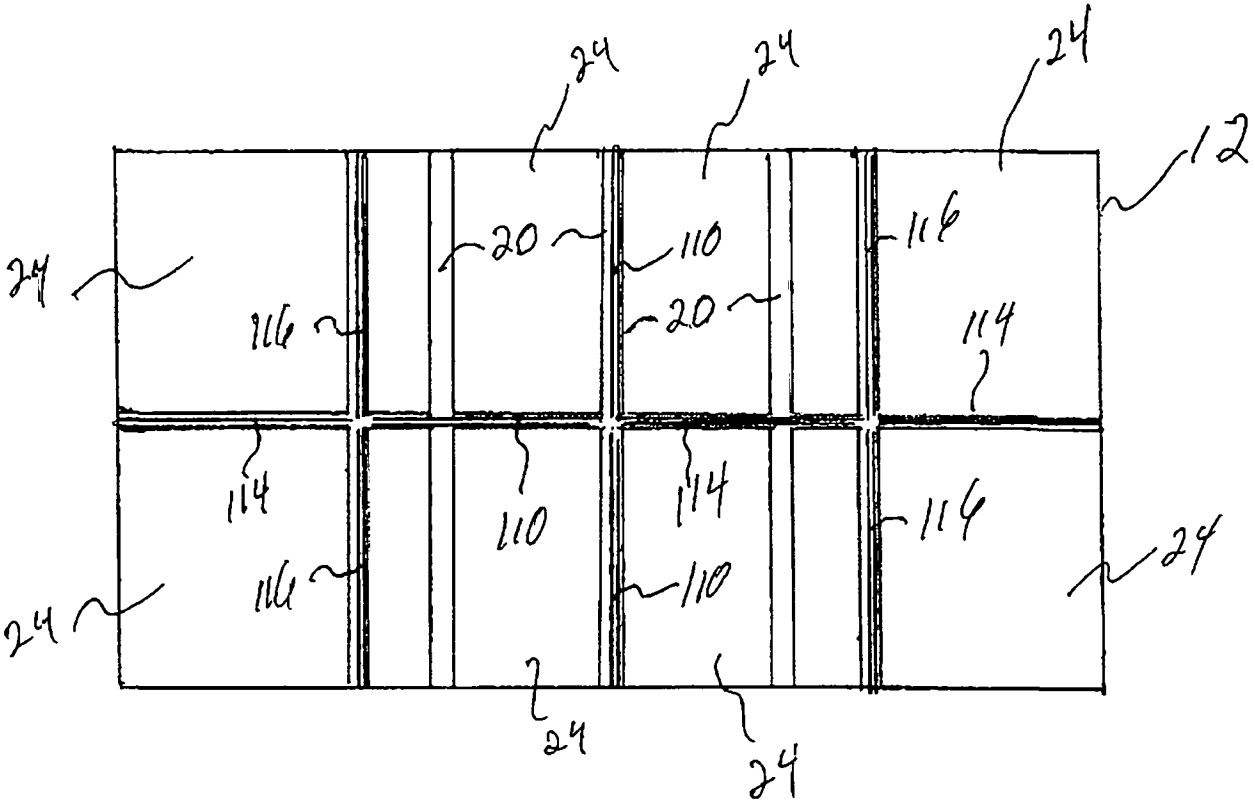
FIG. 11 is the top elevation view of FIG. 1, but with longitudinal and lateral chamber walls inserted in only the channels required to construct the eight sock chambers with the eight chamber covers depicted in FIG. 5.

Referring to FIG. 5, a predetermined number of chamber walls 22 are configured and dimensioned to snugly insert into selected channels 20 in the container 12, thereby forming a predetermined number of sock chambers 24 for disposing preselected socks in corresponding identified chambers 24 until a person, corresponding to an identified chamber 24, removes socks from the corresponding identified chamber 24 by positioning a corresponding chamber cover 26 in an open position. The chamber covers 26 are dimensioned and configured to engage and be supported by top edge portions 110 of corresponding chamber walls 22 such that edge portions 112 of the chamber covers 26 engage the top edge portions 110 of the corresponding chamber walls 22 without engaging adjacent chamber covers 26. The chamber covers 26 will completely cover the respective sock chamber 24 when the chamber covers 26 completely engage the periphery of the top edge portion 110 of the corresponding chamber walls 22. Alternatively, the chamber covers 26 can be reduced in size to cover a portion of the chamber 24, thereby providing an opening to allow selected socks to be disposed into the corresponding chamber 24, and eliminating the need for the aperture 28 in the covers 26.

Referring to FIGS. 6-11, the chamber walls 22 of the device 10 include longitudinal and lateral chamber walls 114 and 116 fabricated from plastic or similar rigid material. The longitudinal chamber walls 114 include upper recesses 118 and the lateral chamber walls 116 include lower recesses 120. The longitudinal chamber walls 114 are inserted into the first, second and third channels 46, 60 and 74 such that upper recesses 118 are disposed to engage cooperating lower recesses 120 in corresponding lateral chamber walls 116 inserted into the fourth, fifth and sixth channels 80, 92 and 104, thereby maintaining the respective positions of the longitudinal and lateral chamber walls 114 and 116 relative to the container 12 when socks are inserted through apertures 28 in chamber covers 26 corresponding to the socks, and when socks are removed from the chambers 24 after the chamber covers 26 are pivoted to an open position.

Figure 12:
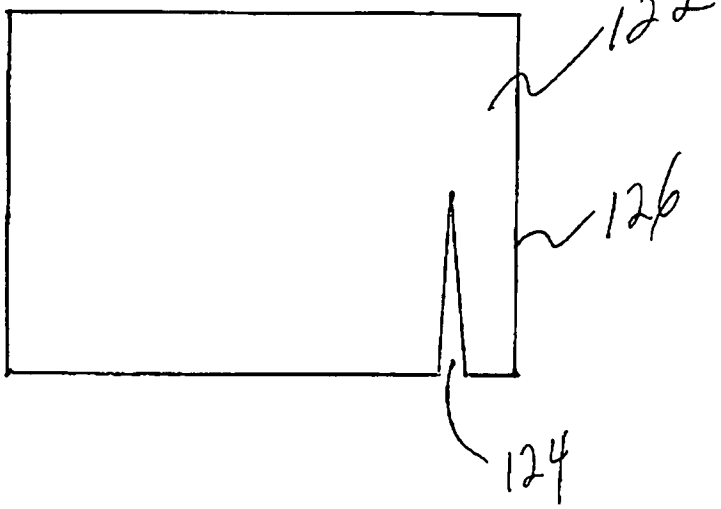
FIG. 12 is the front elevation view of the lateral chamber wall as depicted in FIG. 7, but with the lower recess disposed adjacent to a side edge portion of the lateral chamber wall.

Referring now to FIG. 12, an alternative lateral chamber wall 122 is depicted. The alternative lateral chamber wall 122 includes a lower recess 124 disposed proximate to a side edge 126. The alternative chamber wall 122 allows the user of the device 10 to construct a myriad of sock chambers 24 configurations inside the container 12, thereby enabling to user to increase or decrease the volume of one or more sock chambers 24, via the joining of the longitudinal chamber wall 114 with the alternative lateral chamber wall 122, to correspond to an anticipated quantity of socks for the respective person wearing the socks disposed in the corresponding sock chamber 24.

Referring to FIG. 1, the depicted container 12 can be modified such that the channels 20 are removed, resulting in planar inner walls for a container 12 that is configured and dimensioned to provide a predetermined number of sock chambers for a predetermined quantity of socks. To construct the required sock chambers 24, a predetermined quantity of corresponding configured and dimensioned longitudinal and lateral chamber walls 114 and 116 corresponding to the predetermined number of sock chambers 24 required would be mechanically joined together by mechanical fittings well known to those of ordinary skill in the art. Alternatively, the longitudinal and lateral walls 114 and 116 can be joined together by the cooperating recesses 118 and 120 as described above. The joined chamber walls 114 and 116 would snugly insert into the container 12 such that side edge portions 126 of the chamber walls 114 and 116 snugly engage inner walls of the container 12, thereby eliminating the need for channels 20 inside the container 12. If required, the longitudinal and lateral chamber walls 114 and 116 can be secured to the inner walls of the container 12 via fasteners well known to those of ordinary skill in the art.

Figure 13:
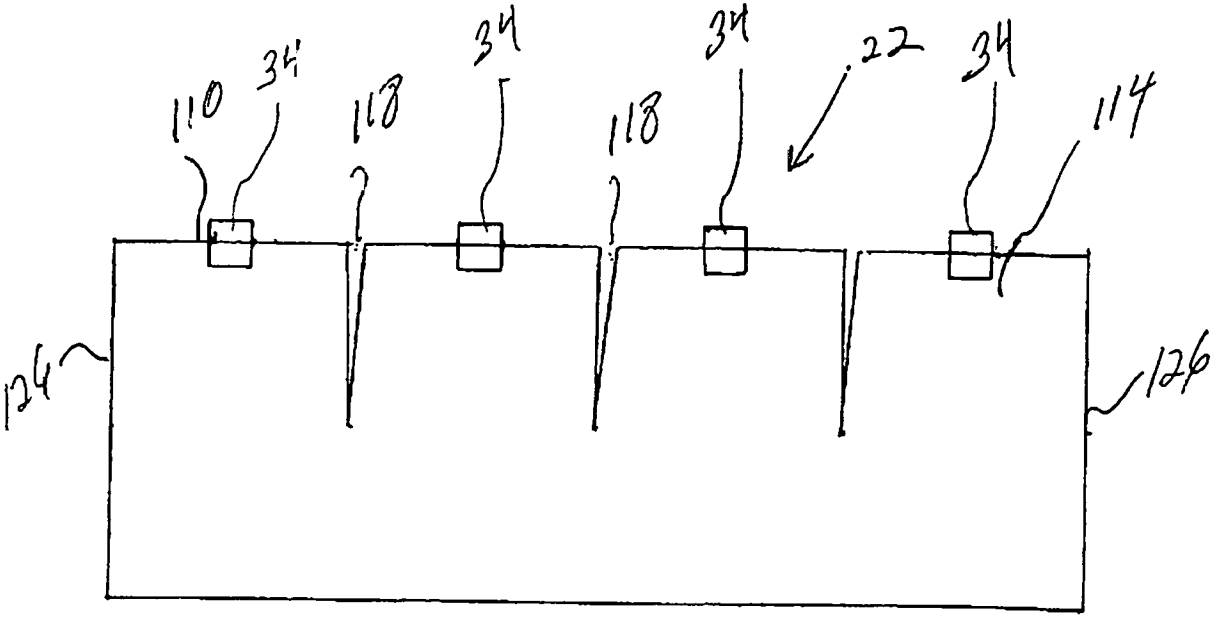
FIG. 13 is the front elevation view of a longitudinal chamber wall with upper recesses of FIG. 6, but with hinges connected to a top edge portion of the chamber wall.
Figure 14:
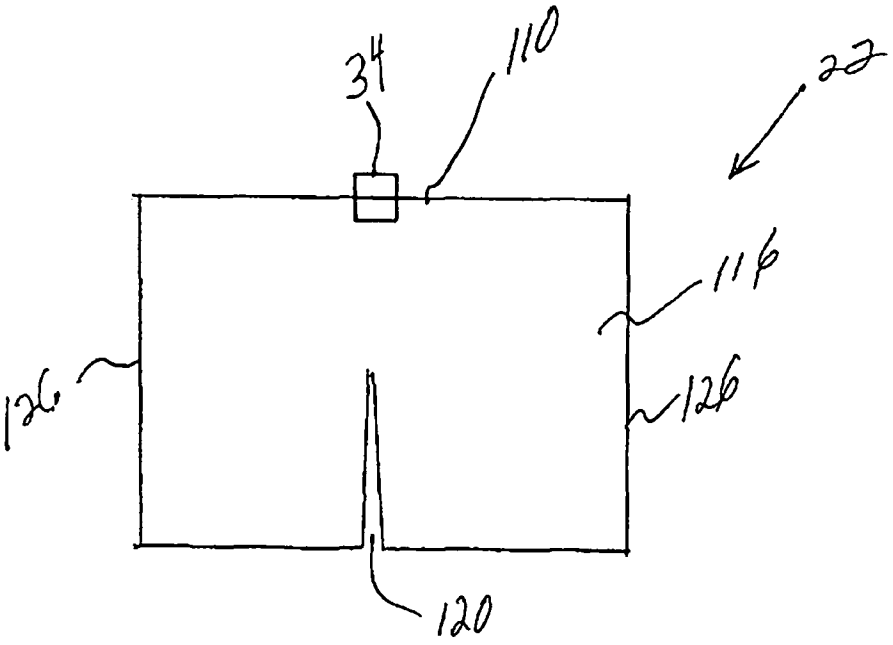
FIG. 14 is the front elevation view of a lateral chamber wall with lower recesses of FIG. 7, but with a hinge connected to a top edge portion of the chamber wall.
Figure 15:
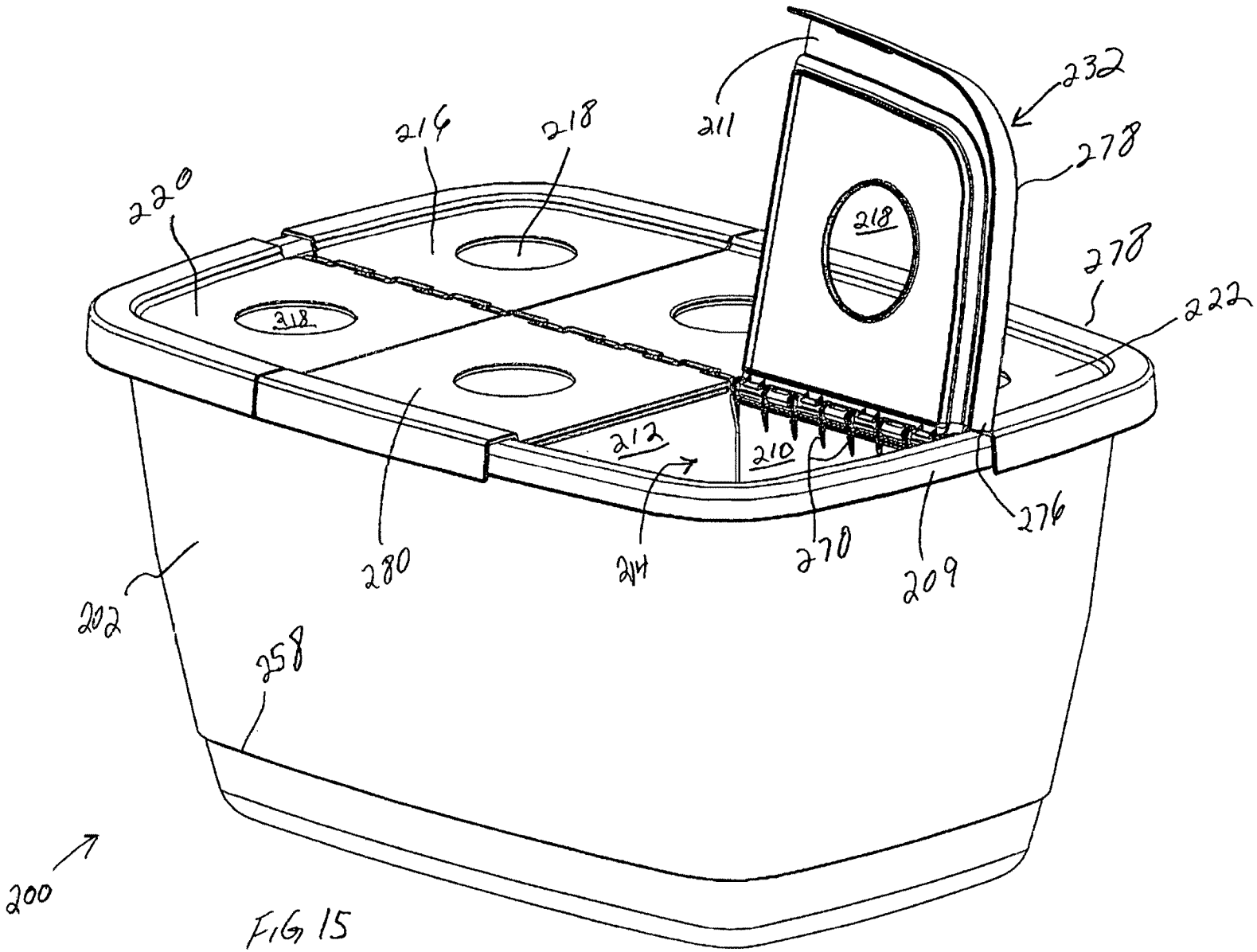
FIG. 15 is a perspective view of an alternative embodiment for a device for grouping socks in accordance with the present invention.
Figure 16:
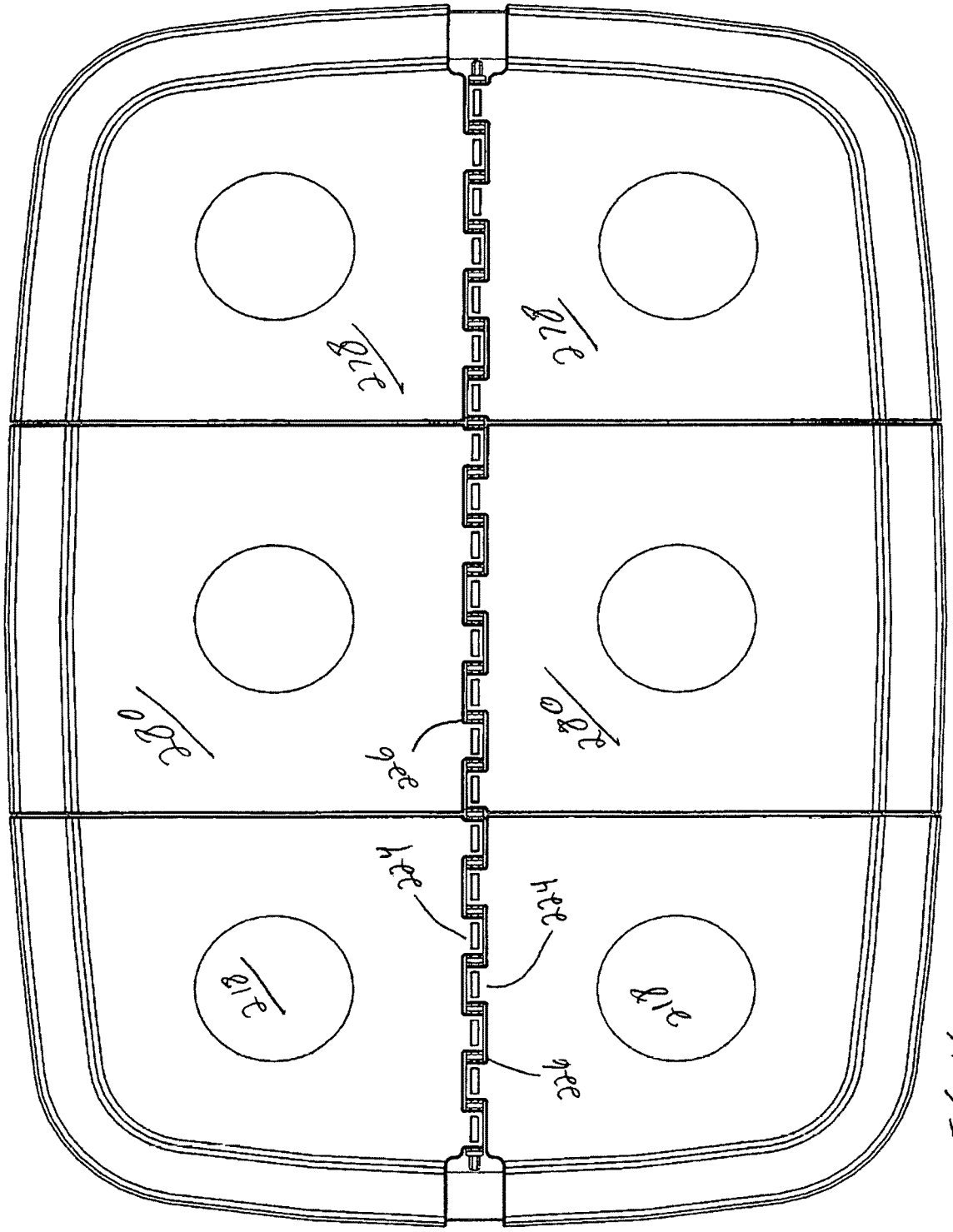
FIG. 16 is a top view of the device of FIG. 15.
Figure 17:
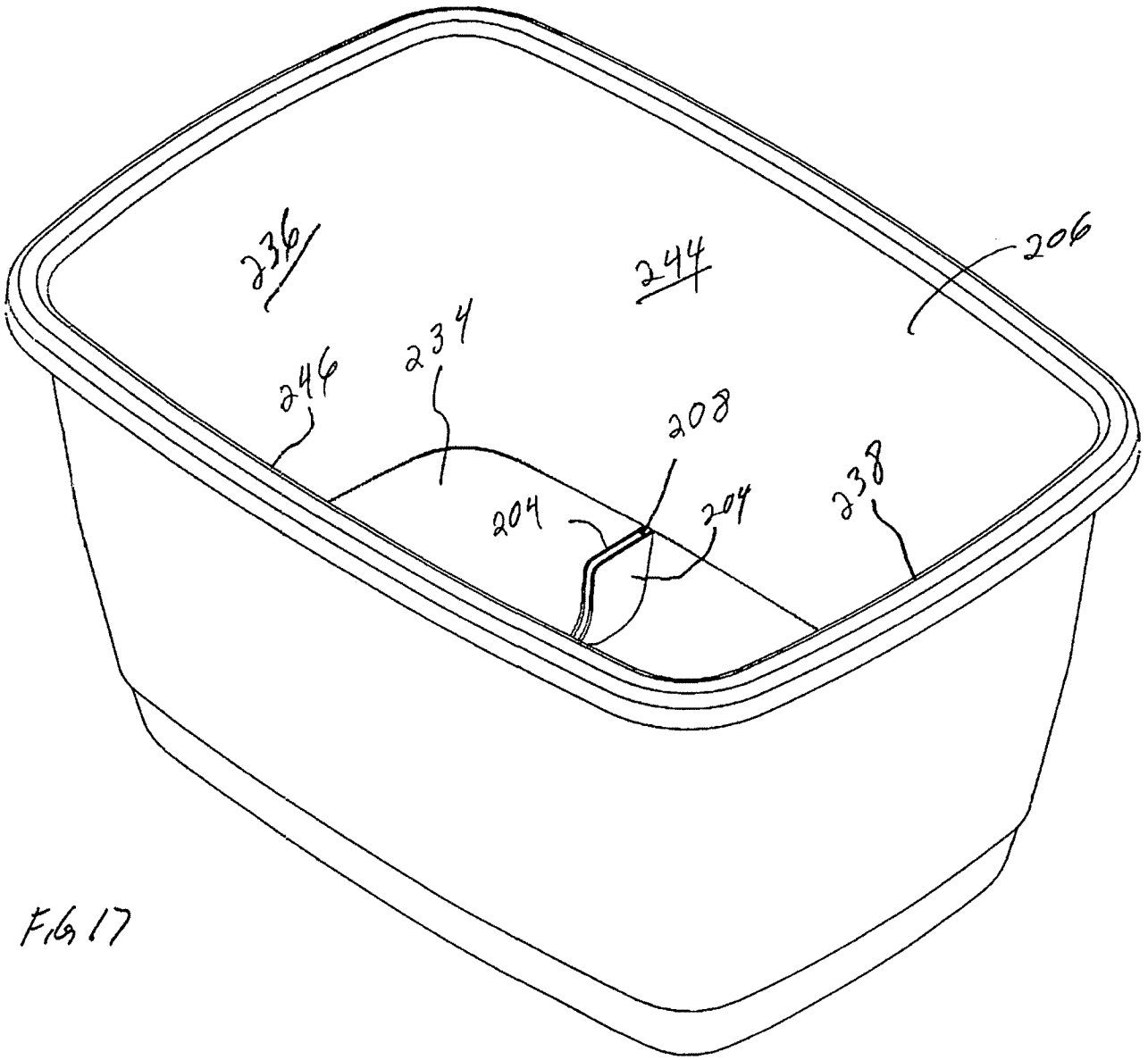
FIG. 17 is a perspective view of a container portion of the device of FIG. 15.
Figure 18:
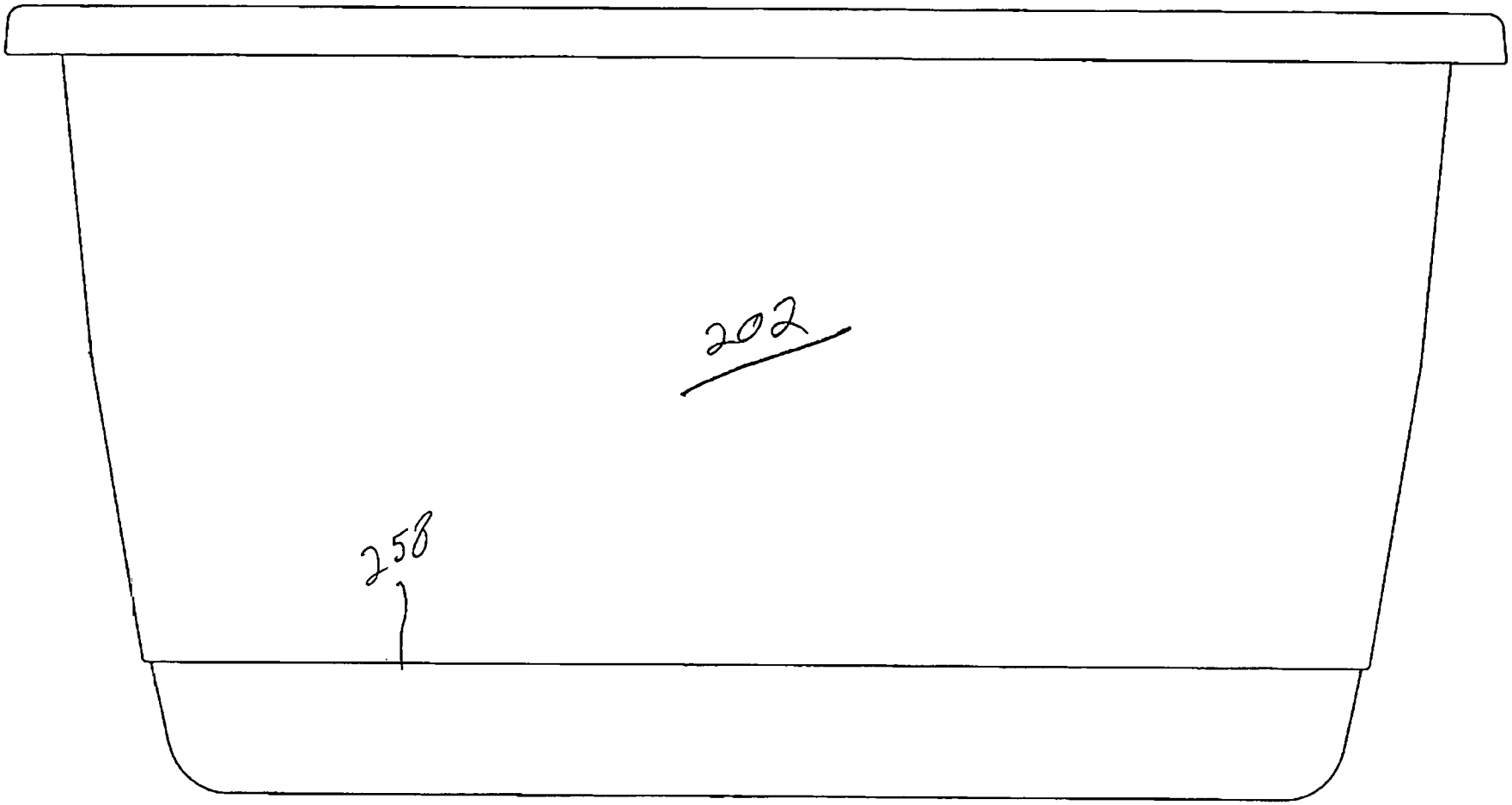
FIG. 18 is a longitudinal side elevation view of the container portion of FIG. 17.
Figure 19:
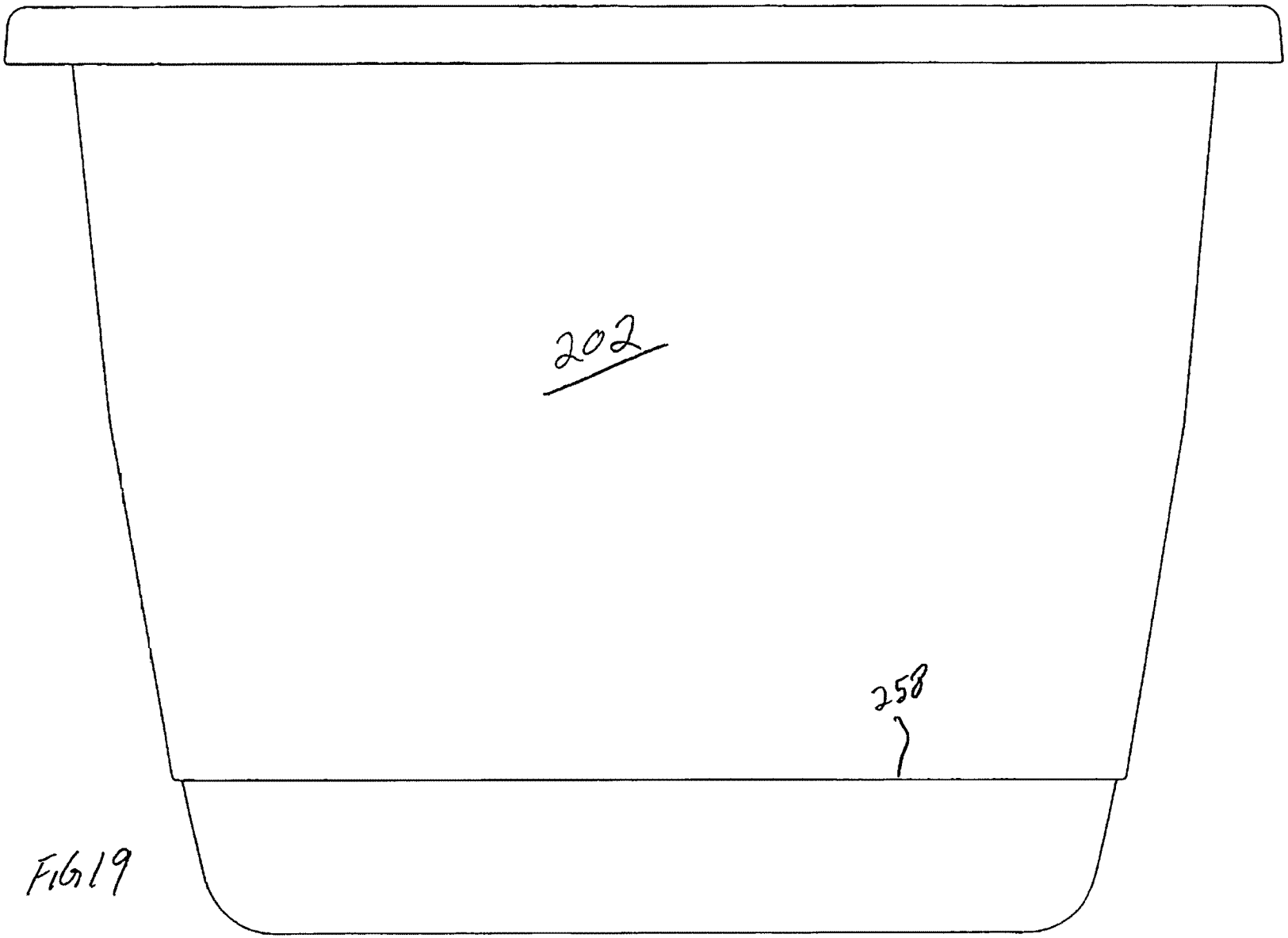
FIG. 19 is a lateral side elevation view of the container portion of FIG. 17.
Figure 20:
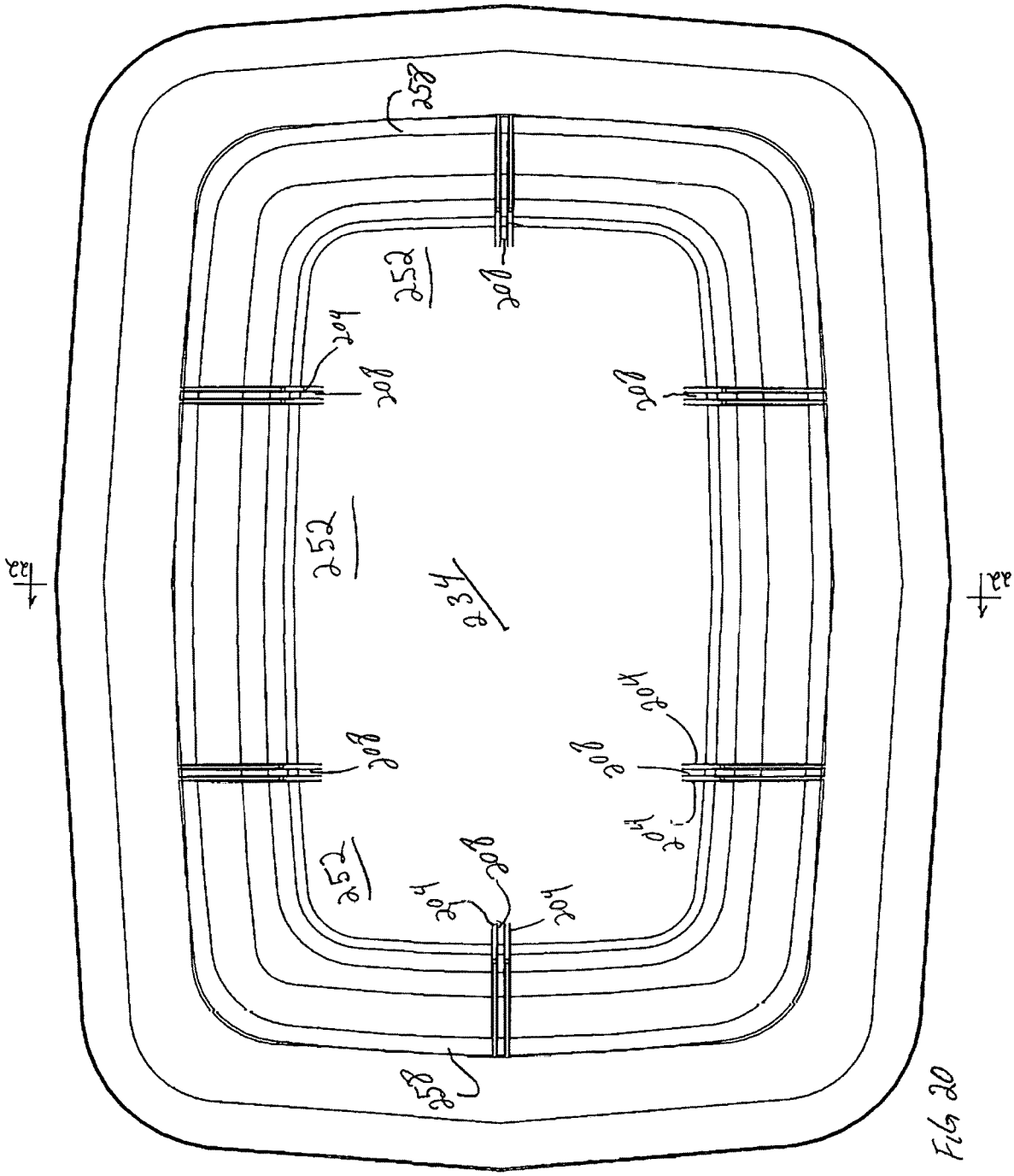
FIG. 20 is a top elevation view of the container portion of FIG. 17.
Figure 21:
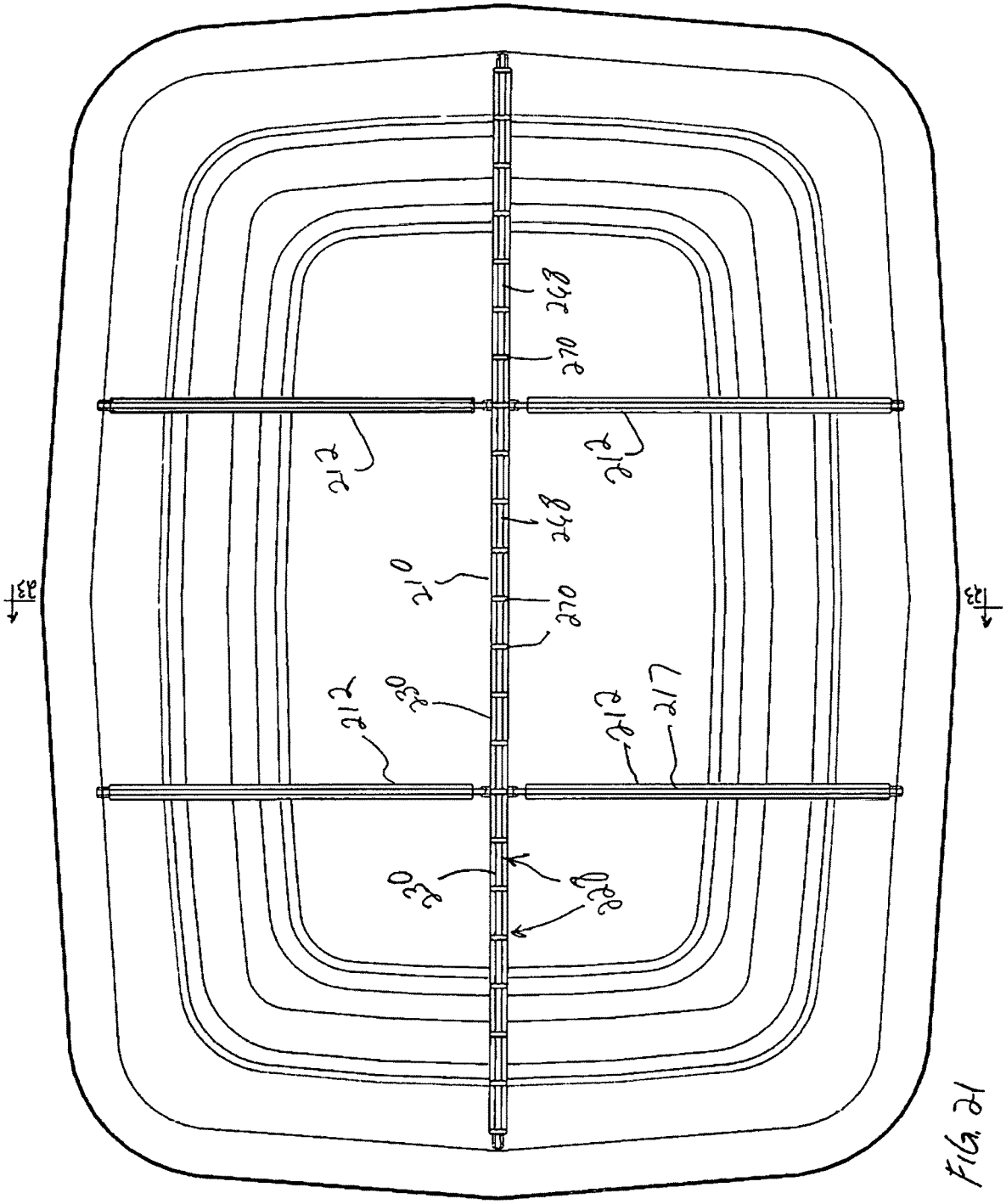
FIG. 21 is the top elevation view of the container portion of FIG. 20, but with lateral and longitudinal chamber walls inserted into the container portion.
Figure 22:
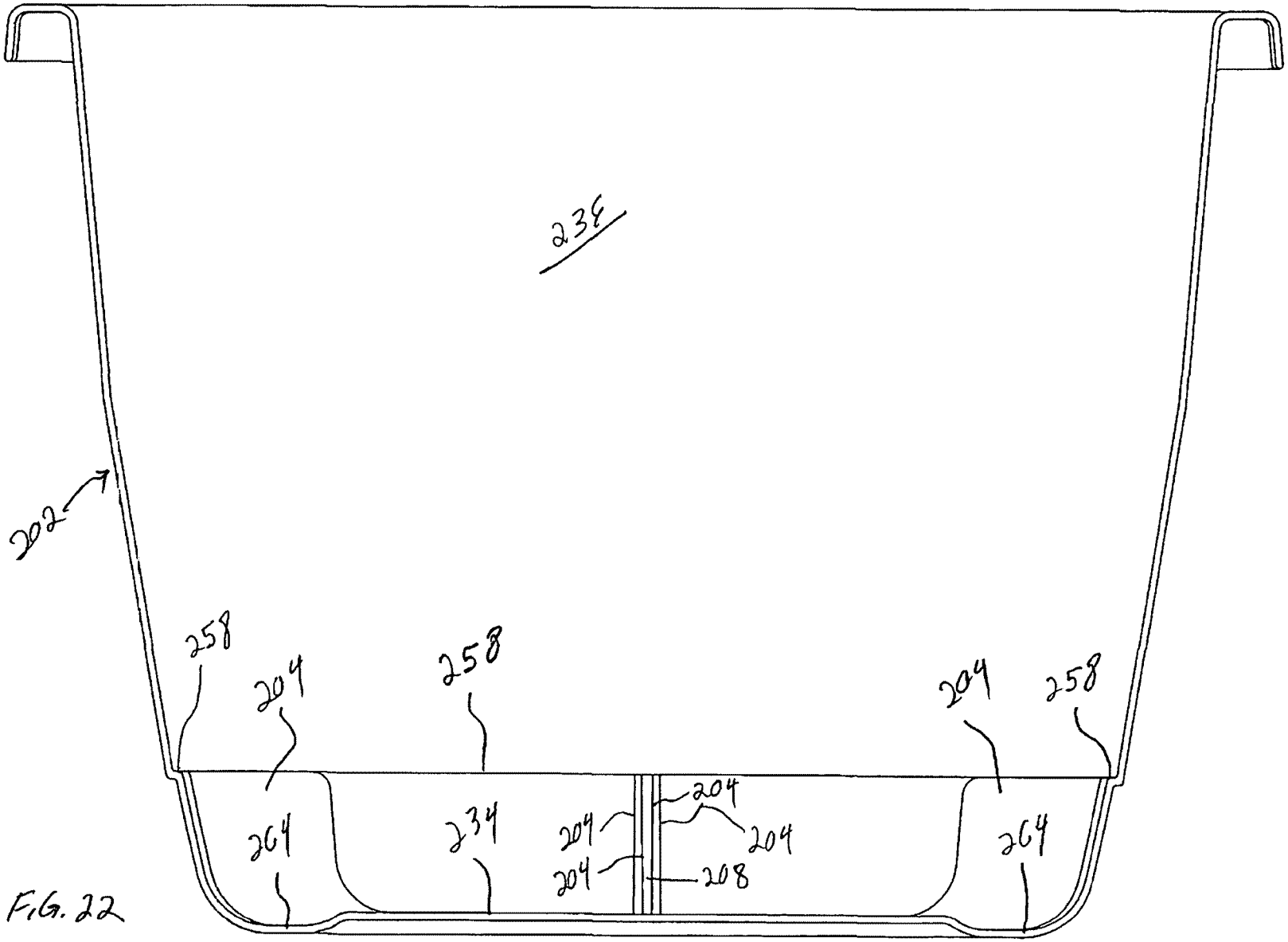
FIG. 22 is a sectional view taken along line 22-22 in FIG. 20.
Figure 23:
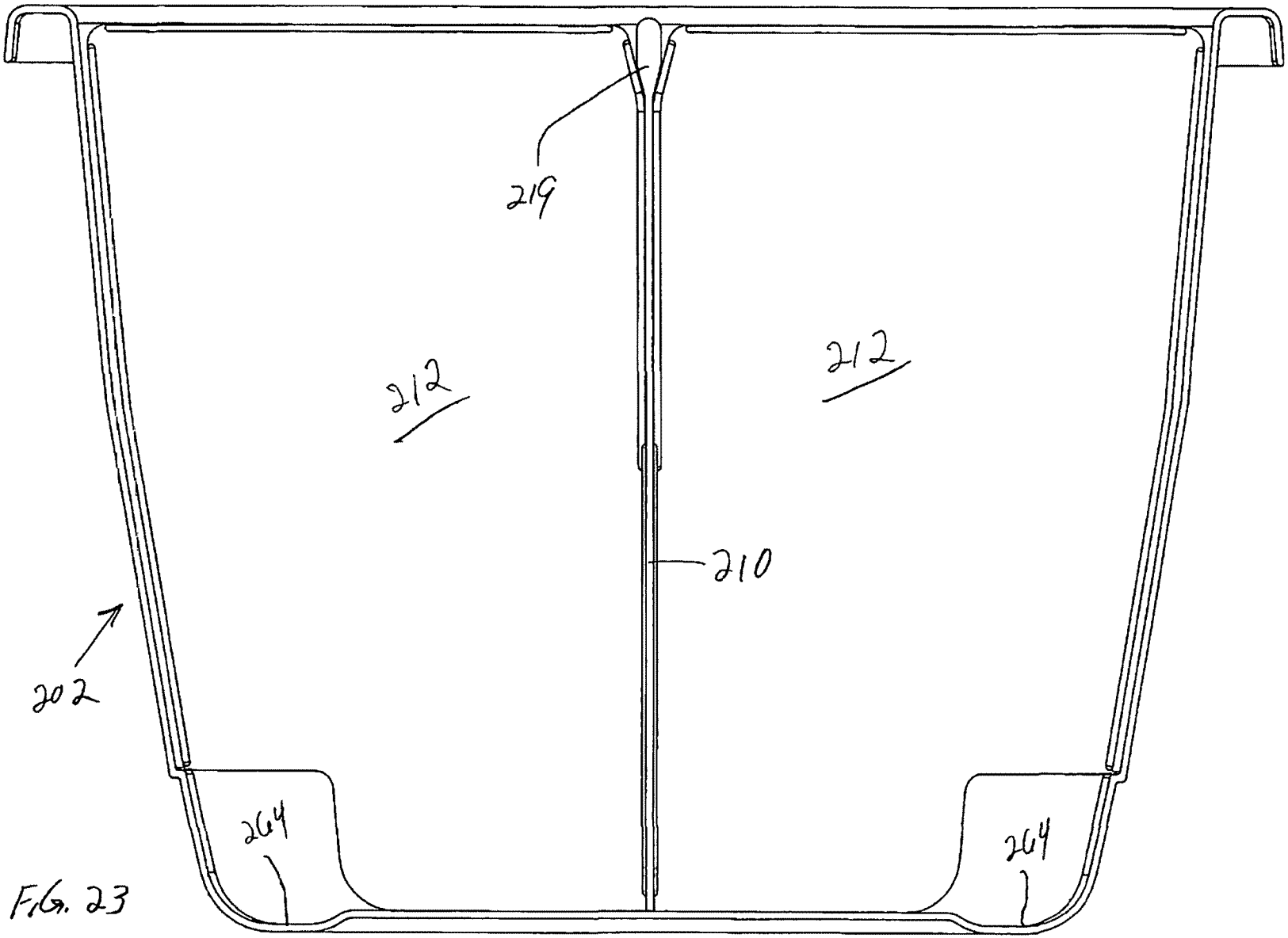
FIG. 23 is a sectional view taken along line 23-23 in FIG. 21.
Figure 24:
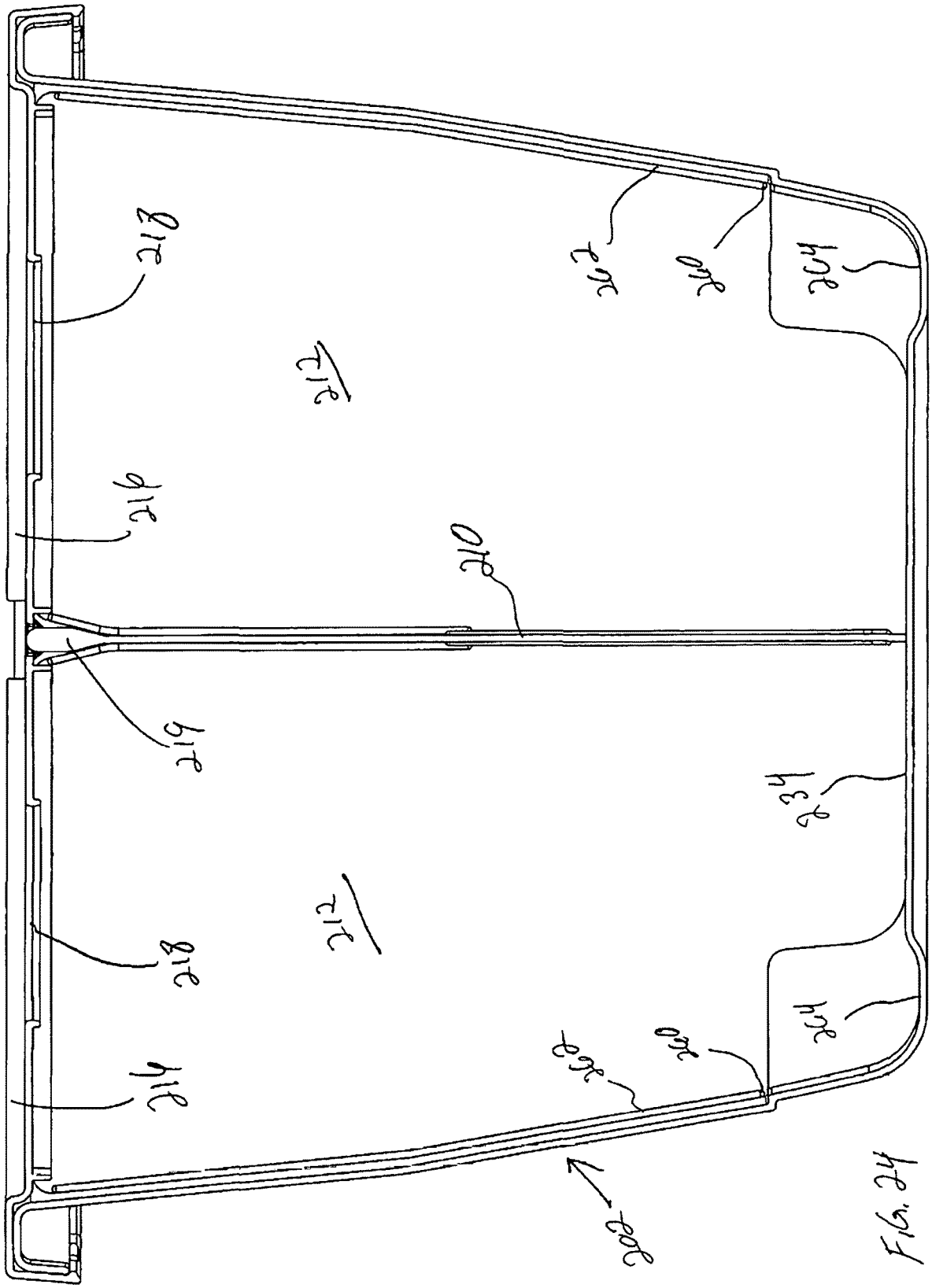
FIG. 24 is the section view of FIG. 23, but with chamber covers disposed upon the container portion, and top edge portions of lateral and longitudinal chamber walls.
Figures 25, 25A:
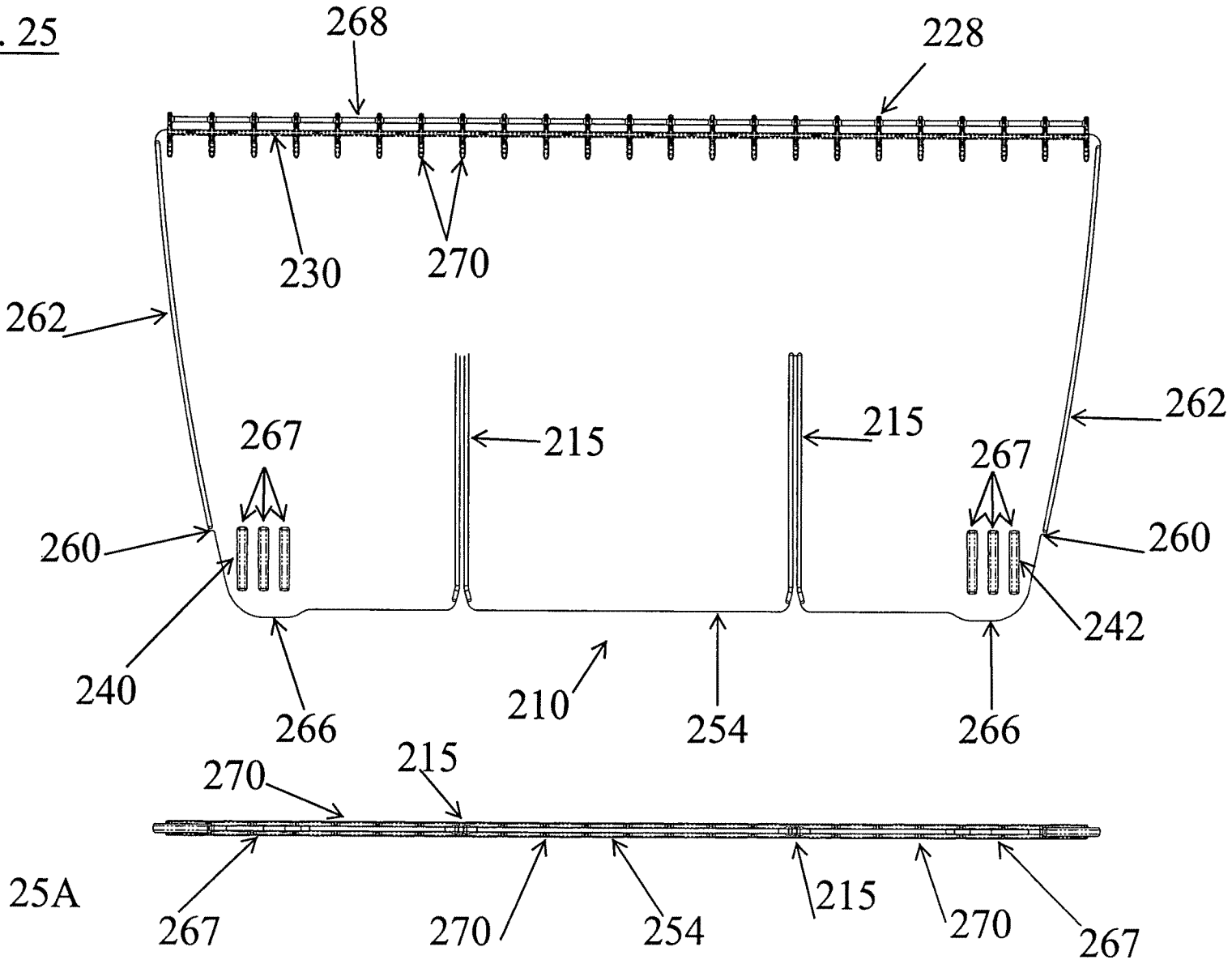
FIG. 25 is a front elevation view of a longitudinal chamber wall in accordance with the present invention.
FIG. 25A is a bottom view of the longitudinal chamber wall of FIG. 25.
Figure 26:
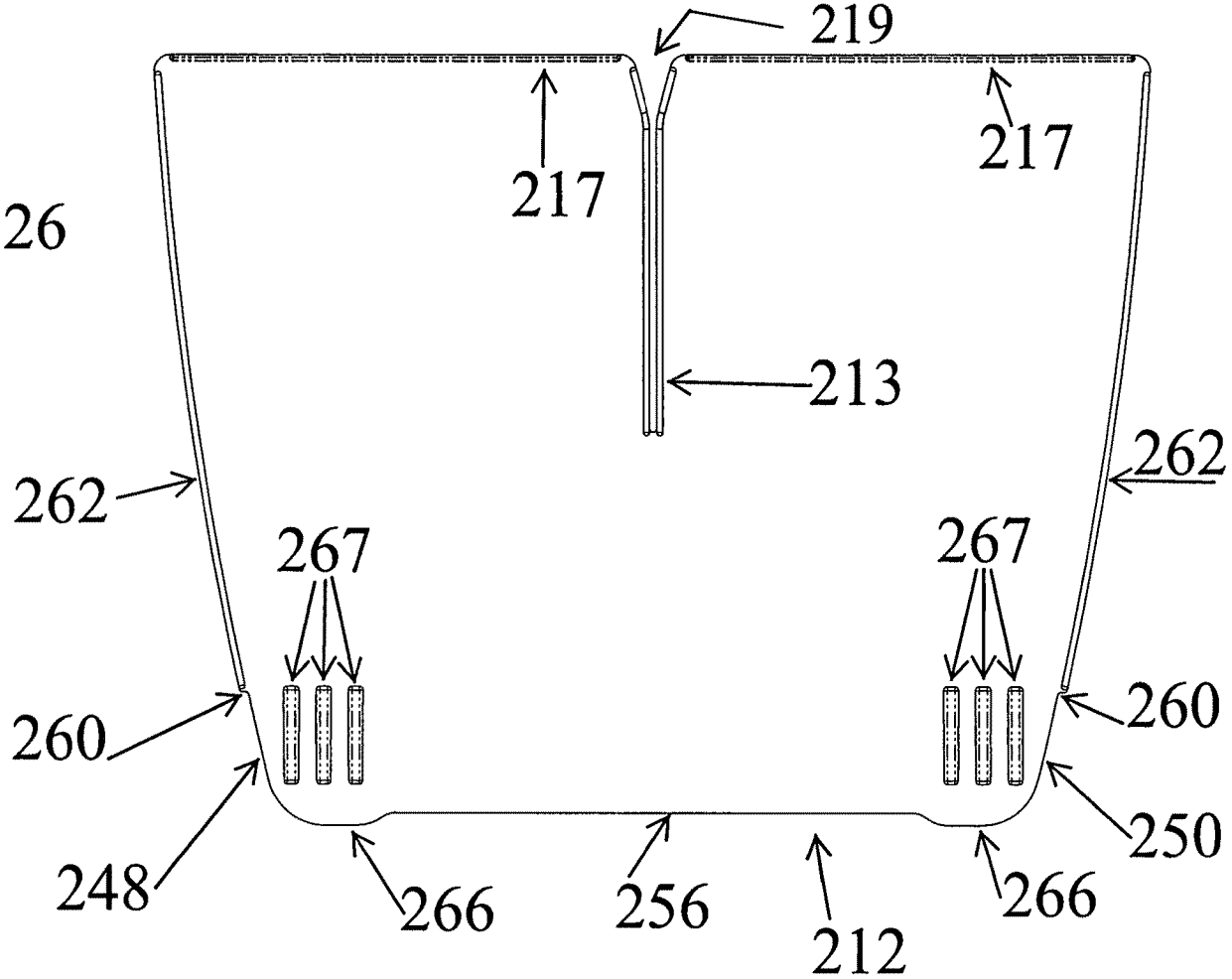
FIG. 26 is a front elevation view of a lateral chamber wall in accordance with the present invention.
Figure 26A:
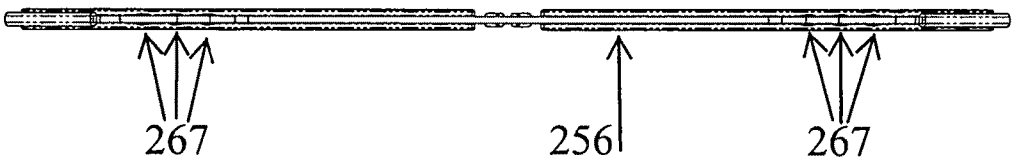
FIG. 26A is a bottom view of the lateral chamber wall of FIG. 26.
Figure 27:
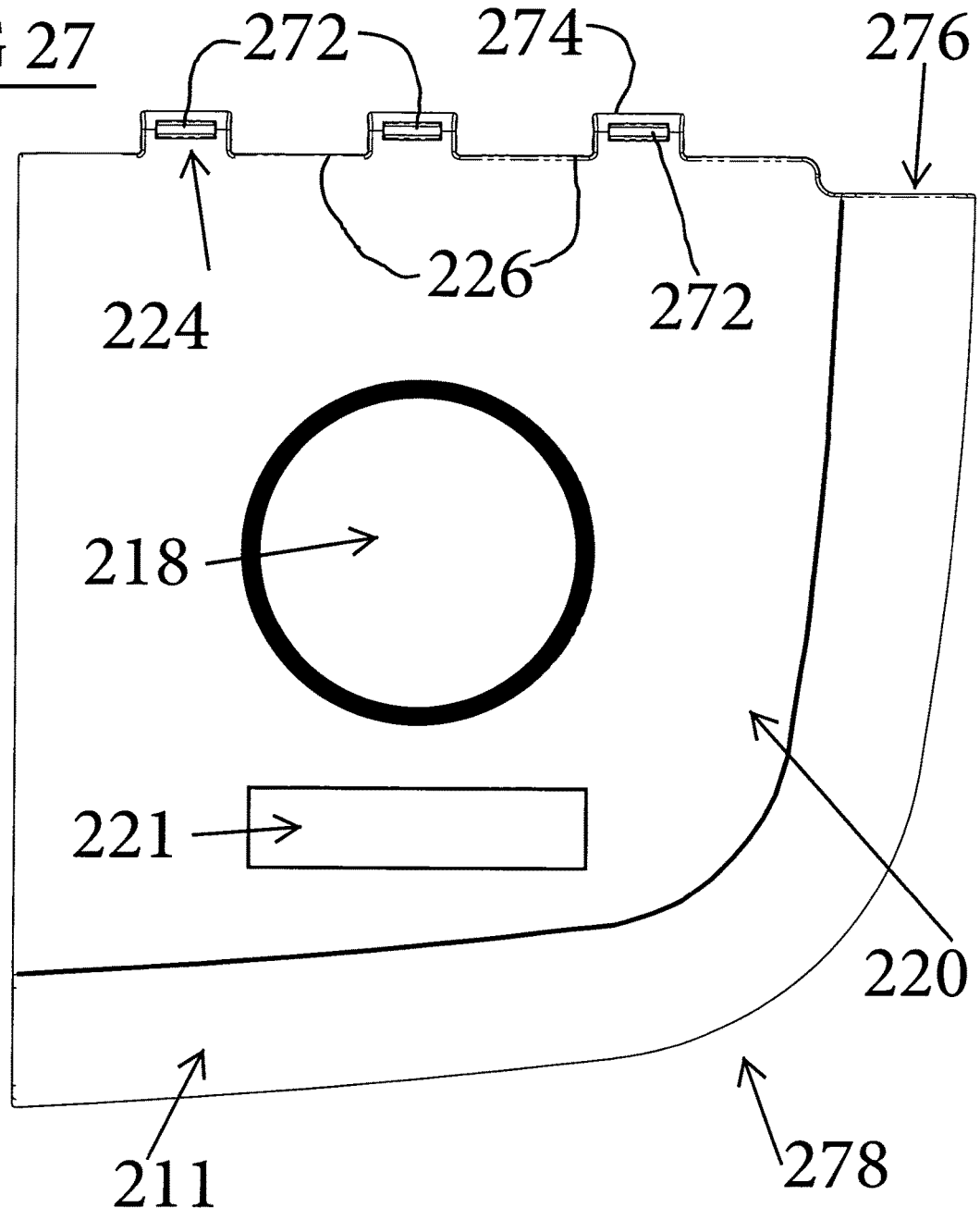
FIG. 27 is a top elevation view of the open outer chamber cover depicted in FIG. 1.
Figure 28:
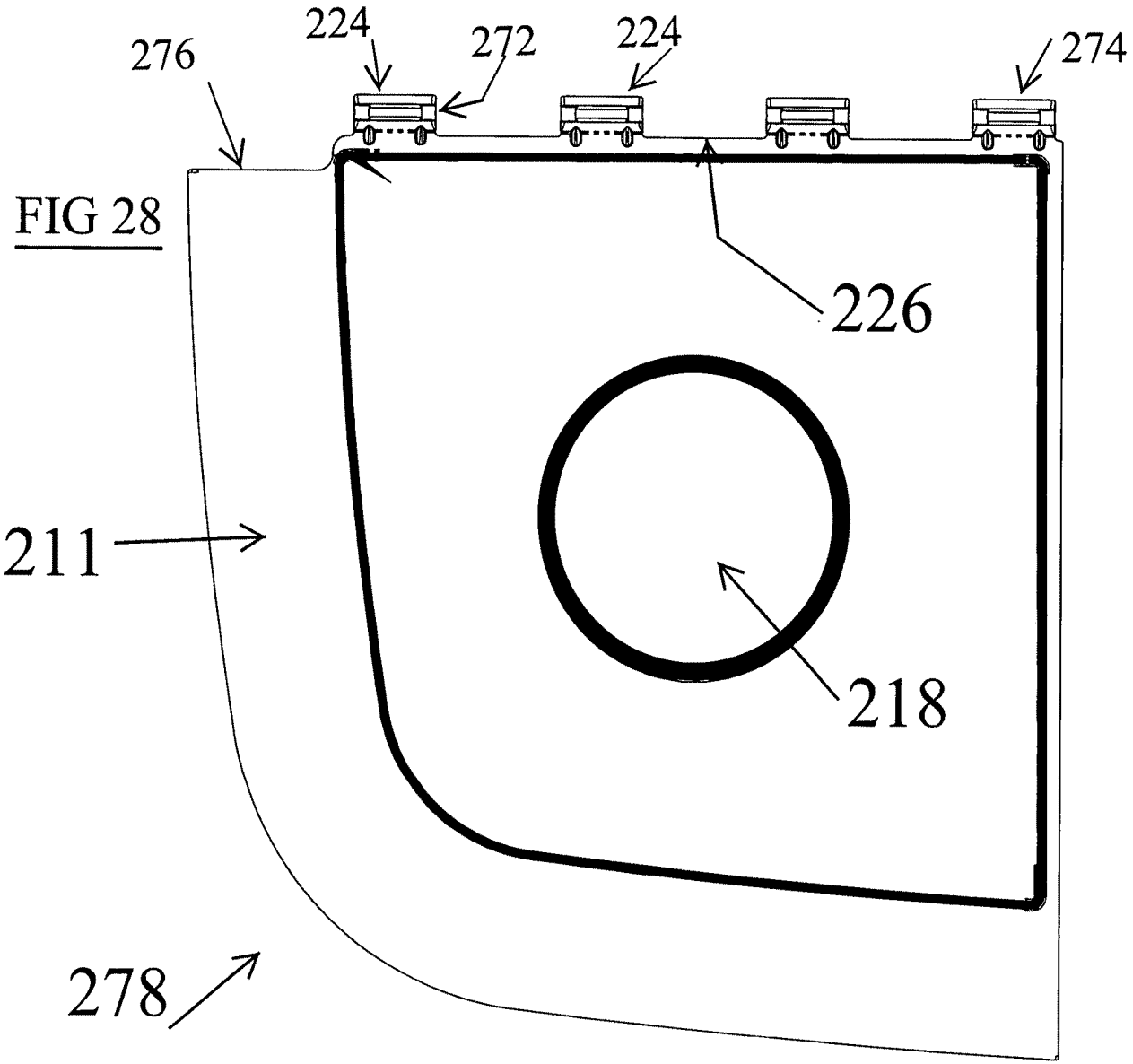
FIG. 28 is a bottom elevation view of the chamber cover of FIG. 27.
Figure 29:
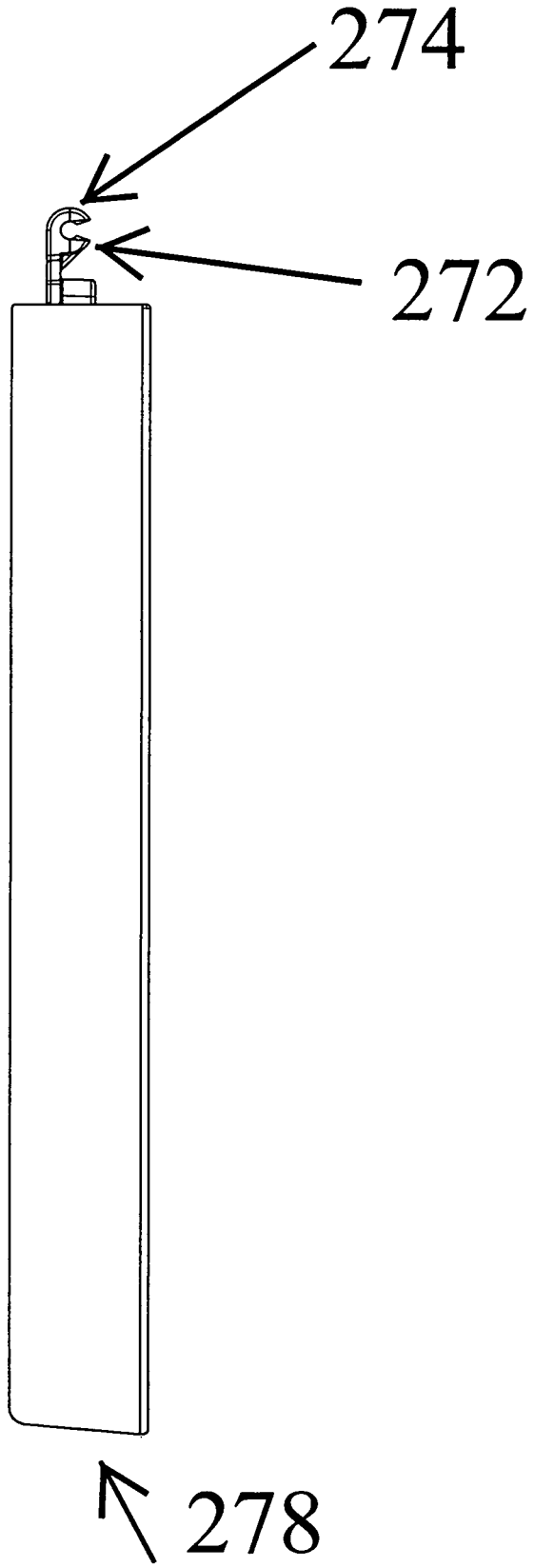
FIG. 29 is a right side elevation view of the chamber cover of FIG. 27.
Figure 30:
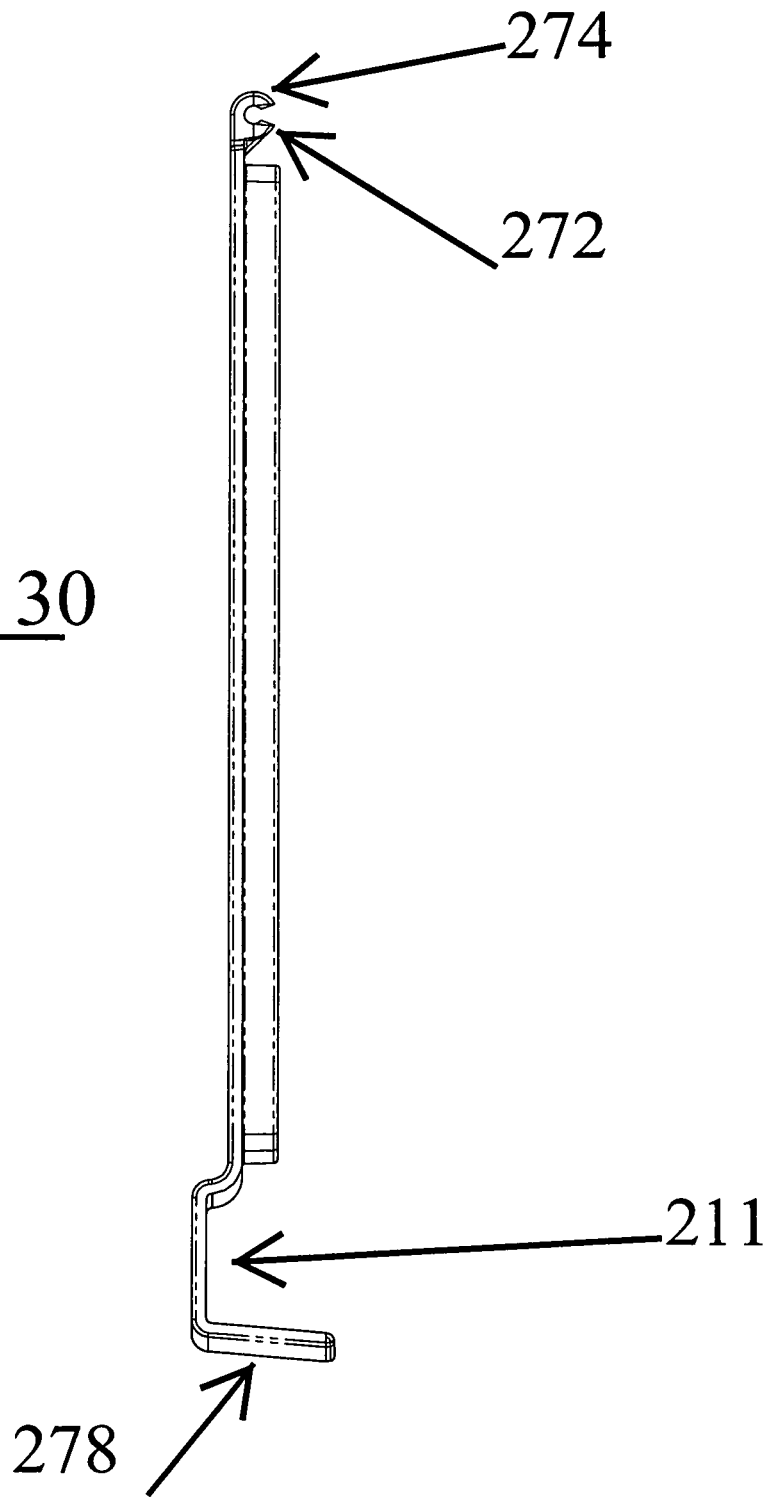
FIG. 30 is a left side elevation view of the chamber cover of FIG. 28.
Figure 31:
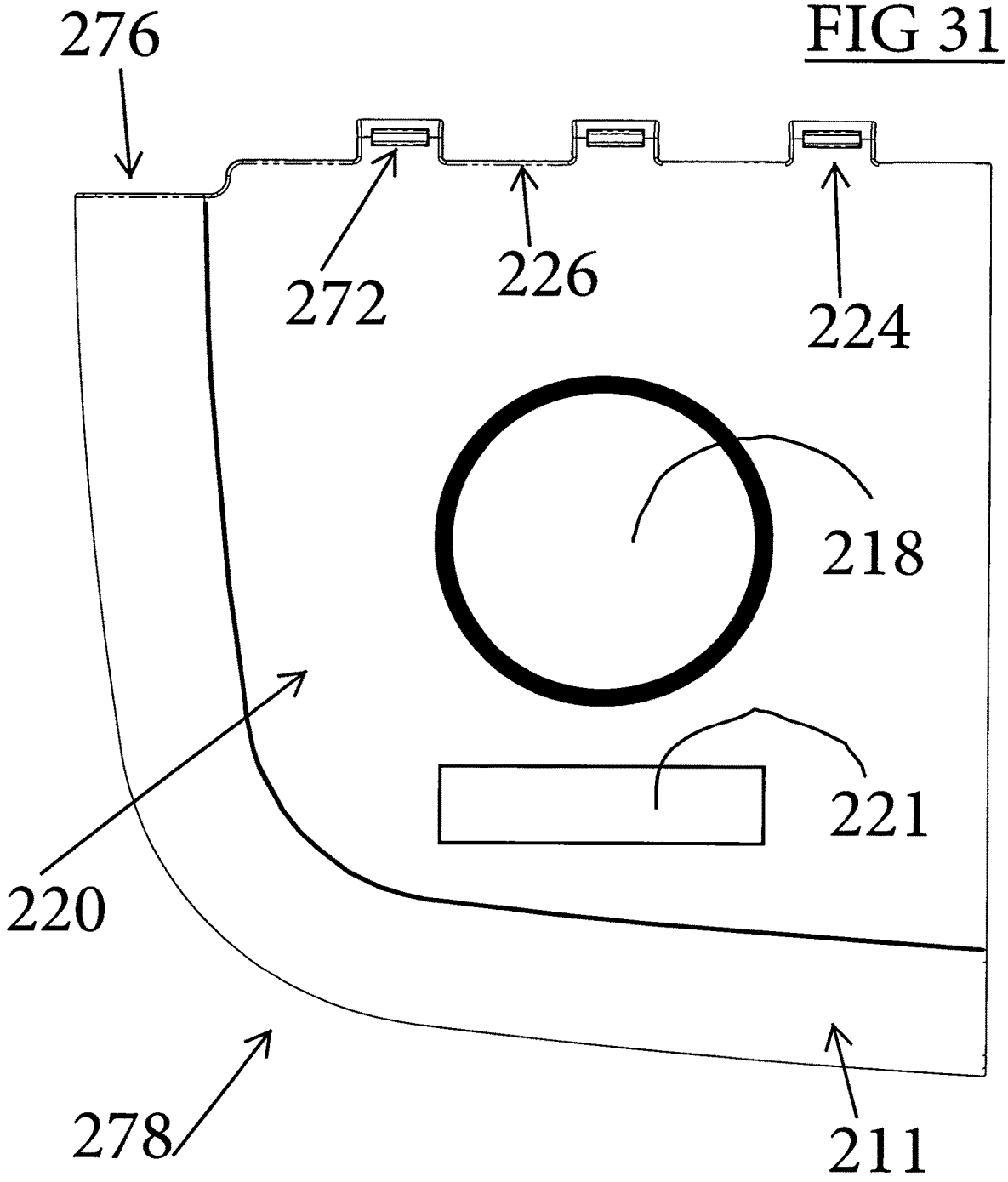
FIG. 31 is a top elevation view of a closed outer chamber cover depicted in FIG. 1.
Figure 32:
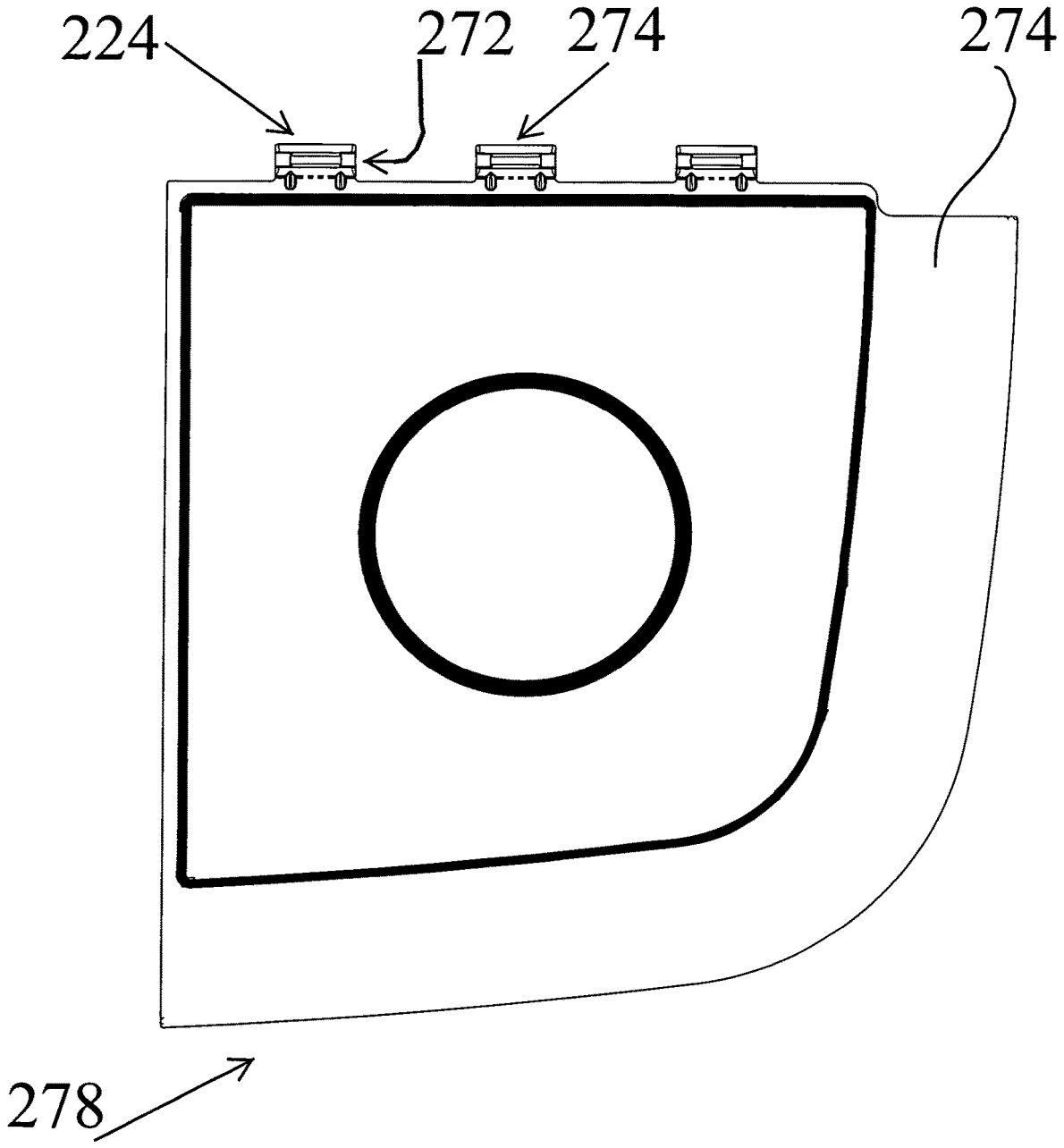
FIG. 32 is a bottom elevation view of the chamber cover of FIG. 31.
Figure 33:
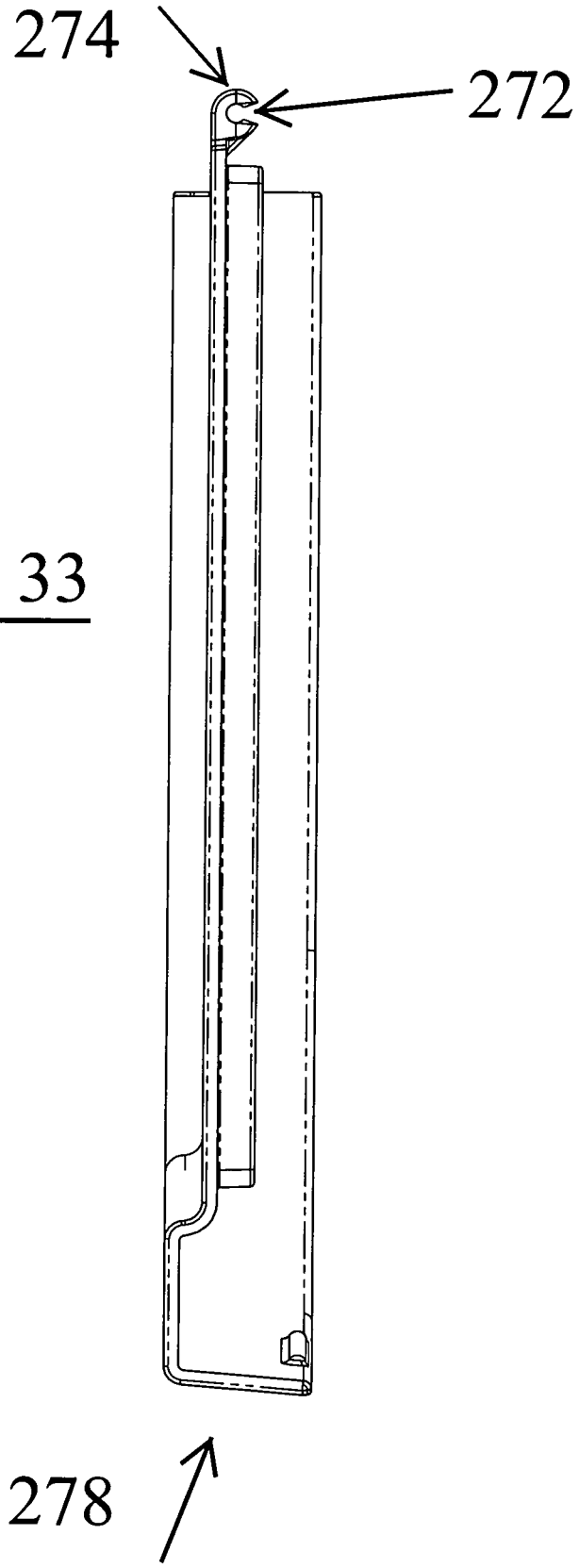
FIG. 33 is a right side elevation view of the chamber cover of FIG. 31.
Figure 34:
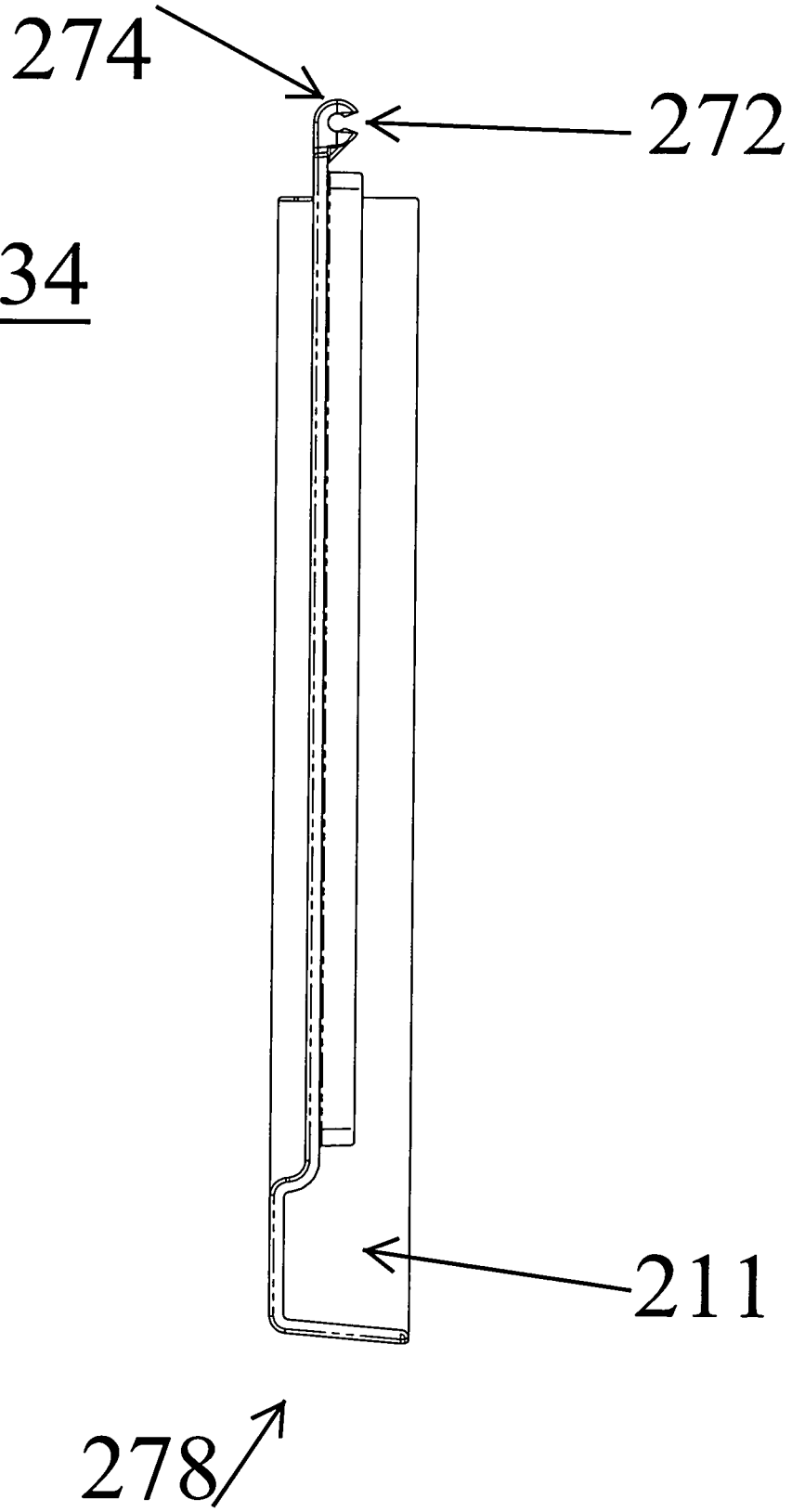
FIG. 34 is a left side elevation view of the chamber cover of FIG. 32.
Figure 35:
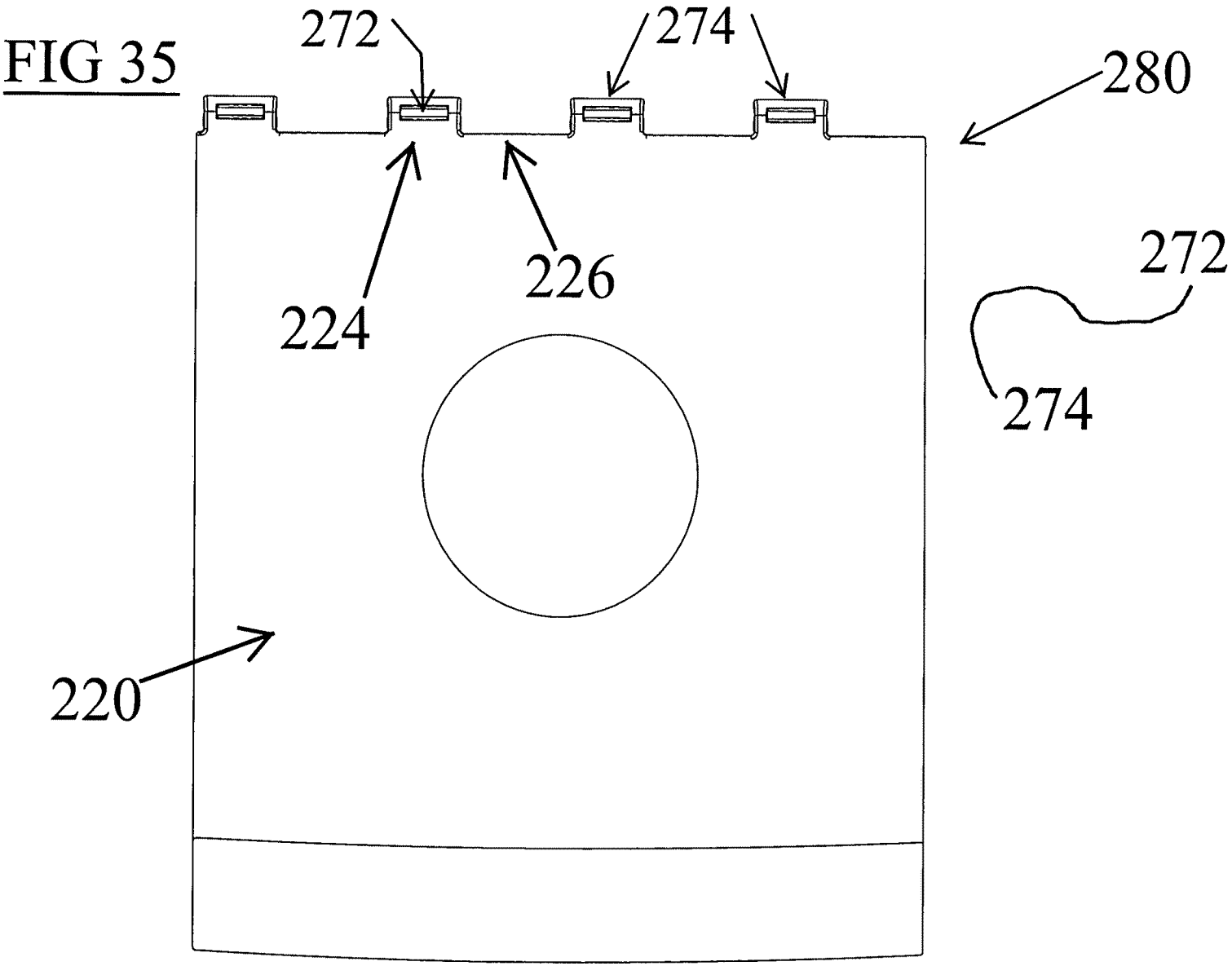
FIG. 35 is a top elevation view of a closed inner chamber cover depicted in FIG. 1.
Figure 36:
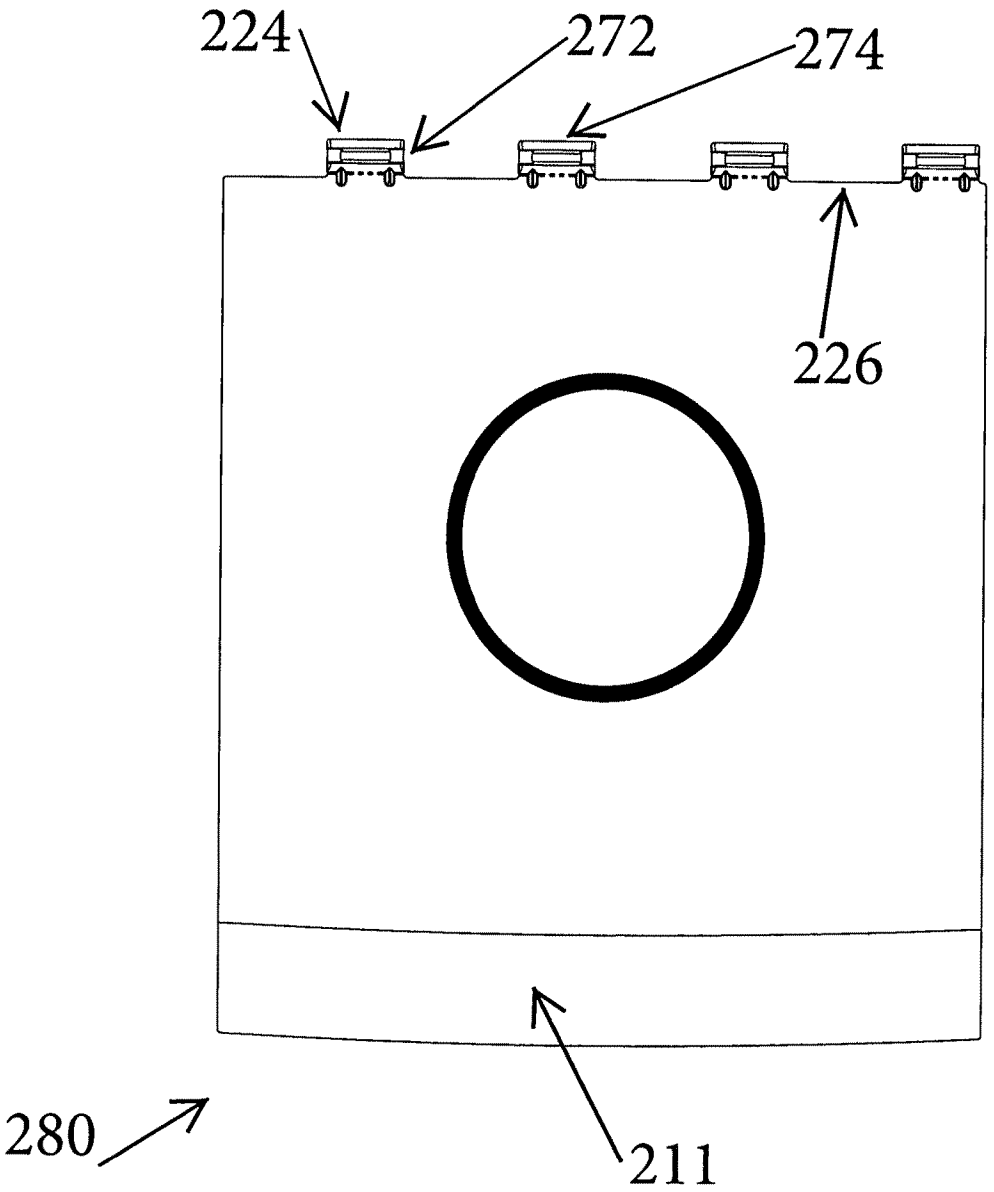
FIG. 36 is a bottom elevation view of the chamber cover of FIG. 35.
Figure 37:
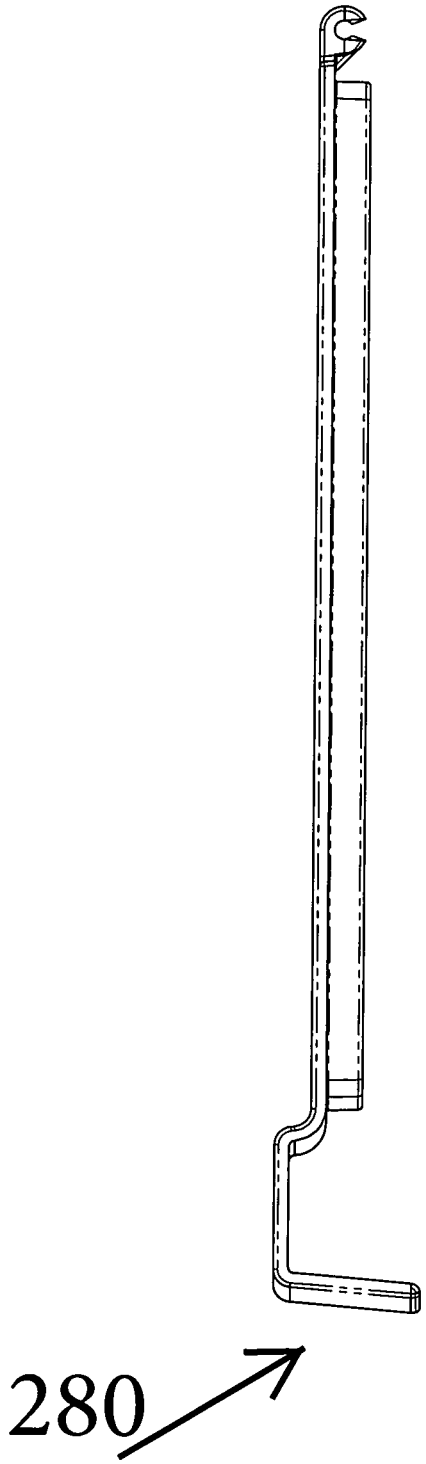
FIG. 37 is a right side elevation view of the chamber cover of FIG. 35.
Figure 38:
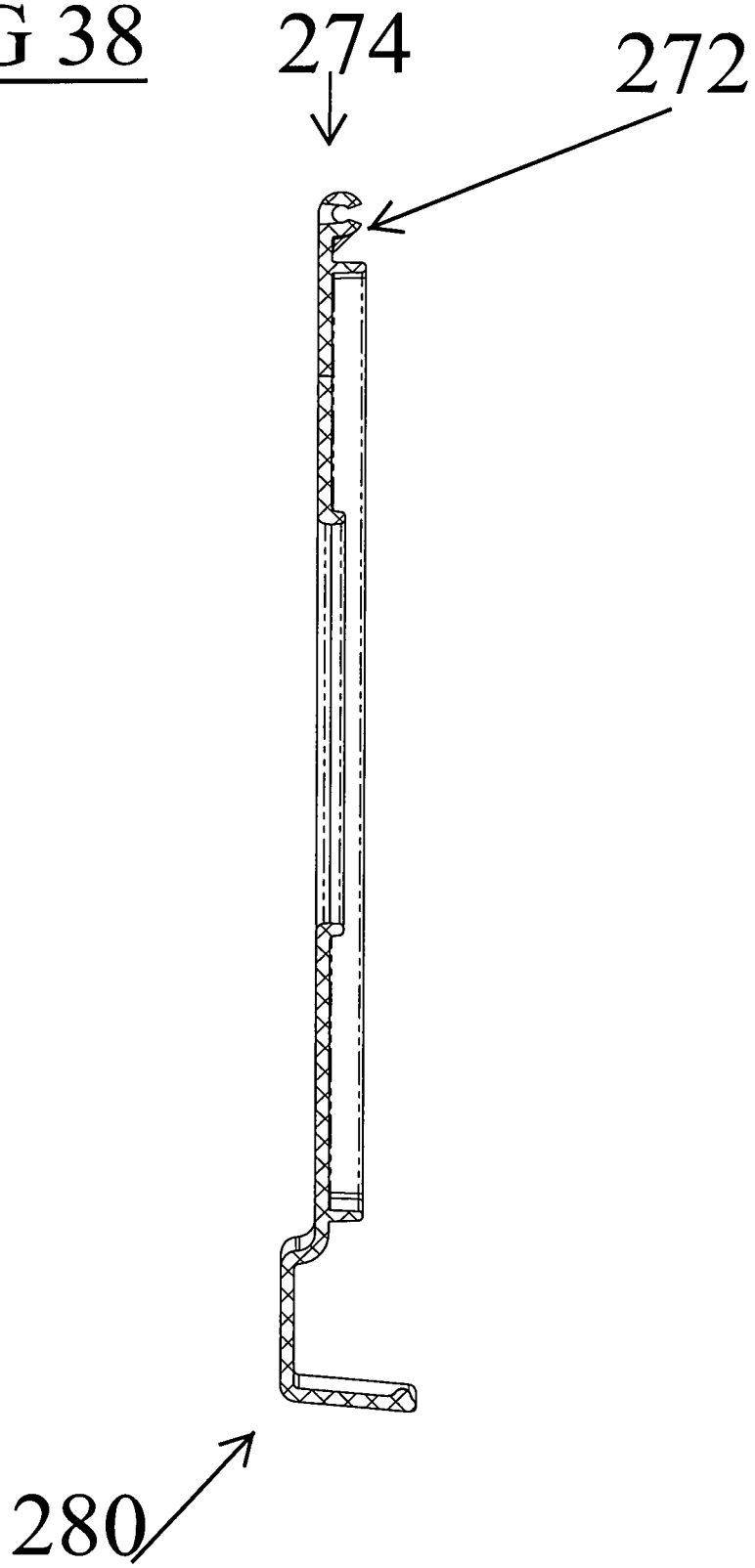
FIG. 38 is a left side elevation view of the chamber cover of FIG. 36.

Referring to FIG. 5, the chamber covers 26 depicted in FIG. 5 and the description above pertaining to the disposition of the chamber covers 26 upon the longitudinal and lateral chamber walls 114 and 116, and attachment of the chamber covers 26 to the container 12 is the same for the device 10 when using a container 12 without any channels 20 joined to the inner walls of the container 12. Further, the hinges 34 can be attached to top edge portions 110 of the longitudinal and lateral chamber walls 114 and 116 as depicted in FIGS. 13 and 14. The respective attached positions of the hinges 34 to the chamber walls 114 and 116 can be modified when the longitudinal chamber wall 114 is positioned with the upper recesses 118 adjacent to the bottom wall 19 of the container, and the lateral chamber walls 116 are positioned adjacent to the covers 26, thereby reversing the joining of the longitudinal and lateral chamber walls 114 and 116. The modified positions of the hinges 34 can vary from being attached to middle sections of the upper edge portions of the chamber walls 114 and 116, to being offset to a position relatively close to one of the side edges 126 of a respective chamber wall 114 and 116.

In operation, the device 10 provides a method for grouping socks that includes selecting a container 12 dimensioned to receive a predetermined quantity of sock groups with each group having a predetermined maximum number of socks; providing chamber walls 114 and 116 that construct an independent sock chamber 24 for each sock group; installing chamber covers 26 over each sock chamber 24, each chamber covers 26 having an aperture 28 to allow selected socks to be disposed in a selected sock chamber 24 when the selected chamber cover 26 is in a closed position, each of the chamber covers 26 having an identification marking on a top surface 30 of each of the chamber covers 26, the identification marking identifying the sock group that is to be disposed into the corresponding sock chamber 24; and providing mechanical members for enabling each of the chamber covers 26 to be independently moved from the closed position to an open position, whereupon, the socks in a selected sock chamber 24 can be manually removed after a corresponding chamber cover 26 for the selected sock chamber 24 is disposed in an open position.

Although the preferred embodiment of the present invention is intended for grouping socks, the present device 10 can be used for storing children's toys, including but not limited to Legos, Polly Pockets and a myriad of other items well known to those of ordinary skill in the art.

Referring now to FIGS. 15-38, an alternative embodiment for a device for grouping socks in accordance with the present invention is denoted as numeral 200. The device 200 includes a container portion 202 having a plurality of ridge walls 204 integrally joined to inner side walls 206 of the container 202. The ridge walls 204 form substantially vertical ridge channels 208 adjacent to the inner side walls 206 of the container 202. The device 200 further includes at least one chamber wall and preferably one longitudinal chamber wall 210 and two lateral chamber walls 212 removably inserted into selected ridge channel 208 in the container 202, thereby forming six sock receiving chambers 214, although alternative quantities of sock receiving chambers 214 can be configured ranging from two to twelve chambers 214 depending upon the configuration and dimensions of the container 202, and the dimensions of the chamber walls 210 and/or 212.

The device 200 further includes six chamber covers 216, although lesser or greater quantities of chambers 214 and cooperating covers 216 can be in the container 202, each of said chamber covers 216 having an aperture 218 substantially centered in the cover 216 to allow selected socks (not depicted) to be disposed in a selected and identified sock receiving chamber 214 when the selected chamber cover 216 is disposed in a closed position 220. The covers 216 include a container receiving channel 211 that snugly engages a relatively wide top edge portion 209 of the container 202 such that when the cover 216 is in closed position 220, the periphery of the cover 216 maintains engagement upon the container 202 and top edge portions 230 and 217 of the longitudinal and lateral chamber walls 210 and 212. The selected sock receiving chamber 214 is identified via name tags 221 or similar identifying elements secured to a top wall 222 of the chamber cover 216, thereby dedicating one sock chamber 214 and cover 216, and the socks disposed in the chamber 214 to be worn by one user named on the chamber cover 216. The identified chamber cover 216 enables a person to organize and separate a relatively large quantity of socks into multiple relatively smaller groups of socks, each group of socks being disposed in a chamber 214 dedicated for the use of one named person who will ultimately wear the socks in only the respective dedicated chamber 214.

The device 200 further includes chamber cover pivot members 224 secured to predetermined edge portions 226 of each of the chamber covers 216. The chamber cover pivot members 224 for each chamber cover 216 independently and cooperatively engage a wall pivot member 228 secured to a top edge portion 230 of the longitudinal chamber wall 210, thereby enabling the chamber covers 216 to independently pivot from a closed position 220 to an open position 232 (and back to a closed position 220), whereupon, the socks in a selected sock receiving chamber 214 can be manually removed after the corresponding chamber cover 216 for the selected sock receiving chamber 214 is disposed in an open position 232.

The ridge walls 204 integrally joined to the inner side walls 206 of the container 202 have a relatively small surface area and are integrally joined to a lower portion of the inner side walls 206 to form the substantially vertical ridge channels 208 adjacent to an inner bottom wall 234 of the container 202.

For a device 200 having six sock receiving chambers 214, two separated sets of ridge walls 204 forming two separated vertical ridge channels 208 are integrally joined to lower portions of an inner first longitudinal wall 244 of the container 202, and two separated sets of ridge walls 204 forming two separated vertical ridge channels 208 oppositely positioned from the channels 208 on the inner first longitudinal wall 244 are integrally joined to lower portions of an inner second longitudinal wall 246 of the container 202. The two sets of ridge channels 208 joined to the first longitudinal inner wall 244 are positioned to receive first side bottom portions 248 of two corresponding lateral chamber walls 212. The two sets of ridge channels 208 joined to the second longitudinal inner wall 246 are positioned to receive second side bottom portions 250 of corresponding lateral chamber walls 212. The ridge walls 204 are separated a distance greater than the thickness of bottom edge portions 266 of the first and second side bottom portions 248 and 250 that insert between the ridge walls 204, thereby promoting relatively easy insertion of the bottom edge portions 266 of the first and second side bottom portions 248 and 250 between the ridge walls 204, until locking protrusions 267 (on one or both planar sides of the chamber wall 212) are disposed between the ridge walls 204, whereupon, the position of the lateral chamber walls 212 relative to the ridge walls 204 are rigidly and snugly maintained.

The first and second bottom edge portions 248 and 250 are slidably inserted into respective ridge channels 208 such that the two lateral chamber walls 212 are parallel orientated and separated a distance that results in three equal volumes 252 in the container 202. Each of the two lateral chamber walls 212 includes a vertical joining slot 213 in a top portion of the lateral chamber walls 212. The vertical joining slot 213 includes a longitudinal centerline that intersects a midpoint of a top edge 217 of the lateral chamber walls 212. The longitudinal dimension of the vertical joining slot 213 is substantially one-half the vertical elevation of the lateral chamber wall 212. The vertical joining slot 213 for each of the two lateral chamber walls 212 further includes a substantially "V" configured upper portion 219 for promoting the insertion of two cooperating vertical joining slots 215 in bottom portions of the longitudinal chamber wall 210 into the corresponding vertical joining slots 213 in the two lateral chamber walls 212 after the two lateral chamber walls 212 have been vertically inserted into the container 202.

For a device 200 having six sock receiving chambers 214, ridge walls 204 forming vertical ridge channels 208 are integrally joined to lower mid-portions of first and second opposite lateral inner walls 236 and 238 of the container 202. The vertical ridge channels 208 formed by the ridge walls 204 joined to the lower mid-portions of the first and second lateral inner walls 236 and 238 of the container 202, ultimately receive respective first and second side bottom portions 240 and 242 of the longitudinal chamber wall 210. The ridge walls 204 are separated a distance greater than the thickness of bottom edge portions 266 of the first and second side bottom portions 240 and 242 that insert between the ridge walls 204, thereby promoting relatively easy insertion of the bottom edge portions 266 of the first and second side bottom portions 240 and 242 between the ridge walls 204, until locking protrusions 267 (on one or both planar sides of the chamber wall 210) are disposed between the ridge walls 204, whereupon, the position of the longitudinal chamber wall 210 relative to the ridge walls 204 is rigidly and snugly maintained. The two vertical joining slots 215 in bottom portions of the longitudinal chamber wall 210 each include a longitudinal dimension that is substantially one-half the lateral dimension or vertical elevation of the longitudinal chamber wall 210. The vertical elevations of the longitudinal and lateral chamber walls 210 and 212 are substantially equal. The vertical dimensions of the longitudinal and lateral chamber walls 210 and 212 together with the longitudinal dimension of the joining slots 213 and 215 of the lateral and longitudinal chamber walls 210 and 212 enable the longitudinal and lateral chamber walls 210 and 212 to slidably combine until bottom edge portions 254 and 256 of respective longitudinal and lateral chamber walls 210 and 212 engage the inner bottom wall 234 of the container 202.

As the longitudinal chamber wall 210 is slidably combined upon the lateral chamber walls 212, the first and second side bottom edge portions 240 and 242 of the longitudinal chamber wall 210 ultimately engage and slidably and snugly insert between ridge walls 204 joined to the first and second lateral inner walls 236 and 238 of the container 202. After the longitudinal chamber wall 210 has completely combined with the two lateral chamber walls 212, the bottom edge portions 254 and 256 of the respective chamber walls 210 and 212 engage of the bottom inner wall 234 of the container 202, and the top edge portions 230 and 217 of respective chamber walls 210 and 212 are substantially planar, resulting in the entire periphery of all chamber covers 216 being supported by the top edge portions 230 and 217 when the chamber covers 216 are dimensioned and configured to engage and be supported by the top edge portions 230 and 217 of corresponding chamber walls, such that all edge portions of the chamber covers 216 engage the top edge portions 230 and 217 of respective chamber walls 210 and 212 without engaging edge portions of adjacent chamber covers 216, irrespective of cover movement from closed 220 to open 232, or from open 232 to closed 220 positions.

To increase the vertical stability of the chamber walls 210 and 212, the vertical dimensions of the ridge walls 204 can be increased such that the ridge walls 204 and the corresponding vertical ridge channels 208 extend from a top portion 207 of the inner side walls 206 of the container 202 to a bottom inner wall 234 of the container 202, thereby providing multiple vertical extended channels 208 adjacent to the inner wall 206, resulting in increased stability for maintaining the position of the longitudinal and lateral chamber walls 210 and 212 inserted into the ridge channels 208.

Securing the position of the bottom edge portions 254 and 256 to maintain the positions of the longitudinal and lateral chamber walls 210 and 212, is achieved by including horizontal recesses in the bottom inner wall 234 of the container 202 for receiving the bottom edges 254 and 256 of cooperating vertically orientated longitudinal and lateral chamber walls 210 and 212, thereby maintaining the position of the longitudinal and lateral chamber walls 210 and 212, irrespective of the quantity of socks disposed in each sock receiving chamber 214.

The container 202 of the sock grouping device 200 includes a lower portion having a substantially horizontal planar shelf wall 258 formed into the periphery of the inner side walls 206 of the container 202 such that the shelf wall 258 engages lower ends 260 of relatively thicker upper first and second side edge portions 262 of the longitudinal and lateral chamber walls 210 and 212 when compared to respective first and second side bottom edge portions 240 and 242 of the longitudinal chamber wall 210, and compared to respective first and second side bottom edge portions 248 and 250 of the lateral chamber walls 212. The thickness differential results in the thicker between upper and lower side edge portions stabilizes respective chamber walls 210 and 212 when the lower ends 260 of the chamber walls 210 and 212 engage the shelf wall 258. Further, the relatively thinner first and second side bottom edge portions 240 and 242 of the longitudinal wall 210 and 248, and first and second side bottom edge portions 248 and 250 of the lateral walls 212 when respective first and second side bottom edge portions (240 and 242) and (248 and 250) of the chamber walls 210 and 212 are snugly inserted into cooperating vertical channels 208 adjacent to the inner side walls 206 of the container 202, the positions of the chamber walls 210 and 212 are maintained irrespective of the quantity of socks disposed in each sock receiving chamber 214.

The container 202 further includes a peripheral chamber bottom wall recess 264 in the bottom inner wall 234 of the container 202. The bottom wall recess 264 has an arcuate configuration that cooperates with an arcuate bottom edge portion 266 of the longitudinal and lateral chamber walls 210 and 212 to maintain the position of the chamber walls 210 and 212 relative to the bottom inner wall 234 of the container 202.

The wall pivot member 228 secured to a top edge portion 230 of the longitudinal chamber wall 210 includes a pivot rod 268 elevated above and parallel to the top edge portion 230 of the longitudinal chamber wall 210. The pivot rod 268 is elevated via elevating ribs 270 a distance above the top edge portion 230 of the longitudinal chamber wall 210 that enables the chamber cover pivot members 224 to snugly engage and rotate about the pivot rod 268 without engaging the top edge portion 230 of the longitudinal chamber wall 210. The elevating ribs 270 are horizontally separated a distance that allows the chamber cover pivot members 224 to snugly insert between adjacently disposed elevating ribs 270 such that the chamber cover pivot members 224 are allowed to pivot upon the pivot rod 268 without obstruction from the elevating ribs 270.

The chamber cover pivot members 224 of the chamber cover 216 include an arcuate channel 272 member that pivotally grasps and is secured to the pivot rod 268 between adjacent elevating ribs 270, such that when the chamber cover 216 is pivoted to an open position 232, an arcuate end portion 274 of the arcuate channel 272 pivots about and under the pivot rod 268, and maintains secured arcuate engagement with the pivot rod 268. For outer chamber covers 278, the curved end portion 274 of the arcuate channel 272 is allowed to pivot under the pivot rod 268 until an edge portion 276 of the chamber cover receiving channel 211 engages an adjacent chamber cover receiving channel 211 of an adjacent outer chamber cover 278, thereby positioning the pivoted chamber cover 216 in a retained open position that forms an acute angle with the top wall 222 of the adjacent outer chamber cover 278. For inner chamber covers 280, the curved end portion 274 of the arcuate channel 272 is allowed to pivot under the pivot rod 268 until the top wall 222 of the pivoted inner chamber cover 280 engages an adjacent top wall 222 of an adjacent closed inner chamber cover 280, thereby positioning the pivoted inner chamber cover 280 in a retained open position upon the adjacent closed inner chamber cover 280.

Although the preferred embodiment for the alternative device 200 includes six chambers, the number of chambers can be varied by increasing the number and locations of ridge walls 204 joined to the inner side walls 206 of the container 202, and correspondingly increasing number of lateral chamber walls 212 inserted into the ridge channels 208 provided by the added ridge walls 204. Further, the six sock receiving chambers 214 of the preferred embodiment is easily modified by removing one lateral chamber wall 212, resulting in a device 202 having four chambers 214: two relatively large chambers formed from combining two smaller chambers, and two original relatively smaller chambers 214. Also, the six chamber device 200 can be converted to a five chamber device by replacing one lateral chamber wall 212 with a "half-chamber" lateral wall similar to the lateral wall 122 depicted in FIG. 12 resulting in one relatively larger chamber and four original relatively smaller chambers. Obviously, if a device 200 was required having four sock receiving chambers 214, the configurations for the corresponding container 202 could be rectangular, which would include four lineally aligned chambers 214 having three parallel lateral chamber walls 212 providing the chambers 214; or square, which would include two lateral chamber walls 212 perpendicularly joined in a cross pattern to form the chambers 214.

The foregoing description is for purposes of illustration only and is not intended to limit the scope of protection accorded this invention. The scope of protection is to be measured by the following claims (1-20) pertaining to the alternative embodiment for a device 200 for grouping socks depicted in FIGS. 15-38, which should be interpreted as broadly as the inventive contribution permits.

The invention claimed is:

1. A sock grouping and user identification device for washed, dried socks comprising:

a container having a plurality of ridge walls integrally joined to inner side walls of said container, said ridge walls forming substantially vertical ridge channels adjacent to said inner side walls of said container;

at least one chamber wall removably inserted into a selected ridge channel in said container, said at least one chamber wall forming at least two sock receiving chambers;

at least two chamber covers for covering said at least two sock receiving chambers, each of said chamber covers having an aperture for allowing selected washed, dried socks to be disposed in a sock receiving chamber selected when an identified chamber cover for said selected sock receiving chamber is in a closed position, each of said sock receiving chamber covers being identified via a respective identification tag secured to a top wall of each chamber cover, such that all socks disposed in a respective sock receiving chamber via an aperture in an identified closed chamber cover are for the use of a predetermined user; and chamber cover pivot members secured to predetermined edge portions of each of said chamber covers, said chamber cover pivot members for each chamber cover independently and cooperatively engaging a wall pivot member secured to a top edge portion of a longitudinal chamber wall, thereby enabling said chamber covers to independently pivot from a closed position to an open position, whereupon, the socks in a selected sock receiving chamber can be manually removed after a corresponding chamber cover for said selected sock receiving chamber is disposed in an open position.

2. The sock separation device of claim 1 wherein said plurality of ridge walls integrally joined to said inner side walls of said container engage a lower portion of said inner side walls to form said substantially vertical ridge channels for receiving vertically disposed chamber walls to ultimately form a predetermined number of sock receiving chambers each having a chamber cover with an aperture to allow selected socks to be disposed in said corresponding sock receiving chamber.

3. The sock separation device of claim 2 wherein said container includes ridge walls that form substantially vertical ridge channels extending from a top portion of said inner side walls of said container to a bottom portion of said inner walls of said container, thereby providing multiple vertical channels adjacent to said inner wall of said container, resulting in increased stability for maintaining the position of said chamber walls inserted into said ridge channels relative to said inner container walls.

4. The sock separation device of claim 1 wherein a predetermined number of chamber walls are configured and dimensioned to snugly insert into selected channels in said container, thereby forming a predetermined number of chambers for disposing preselected socks in corresponding identified chambers until a person corresponding to an identified chamber removes socks from said corresponding identified chamber by positioning a corresponding chamber cover in an open position.

5. The sock separation device of claim 1 wherein said chamber covers are dimensioned and configured to engage and be supported by top edge portions of corresponding chamber walls such that edge portions of said chamber covers engage said top edge portions of said corresponding chamber walls without engaging adjacent chamber covers.

6. A sock separation for multiple users device comprising:

a container having a plurality of ridge walls integrally joined to inner side walls of said container, said ridge walls forming substantially vertical ridge channels adjacent to said inner side walls of said container, said plurality of ridge walls engaging a lower portion of said inner side walls to form said substantially vertical ridge channels for receiving vertically disposed chamber walls to ultimately form a predetermined number of sock receiving chambers each having a chamber cover with an aperture to allow selected socks to be disposed in said corresponding sock receiving chamber;

a plurality of chamber walls inserted into corresponding ridge channels in said container, said chamber walls forming a preselected quantity of sock receiving chambers, each chamber ultimately providing socks for a designated user;

a plurality of chamber covers corresponding to the said preselected quantity of sock receiving chambers, each of said chamber covers having an aperture for allowing selected washed, dried socks to be disposed in a sock receiving chamber selected when an identified chamber cover for said selected sock receiving chamber is in a closed position, each of said sock chamber covers being identified via an identification element secured to a top wall of each chamber cover, such that all socks disposed in a respective sock receiving chamber via an aperture in an identified chamber cover are for the use of a predetermined user; and chamber cover pivot members secured to predetermined edge portions of each of said chamber covers, said chamber cover pivot members for each chamber cover independently and cooperatively engaging a wall pivot member secured to a top edge portion of a longitudinal chamber wall, thereby enabling said chamber covers to independently pivot from a closed position to an open position, whereupon, the socks in a selected sock receiving chamber can be manually removed after a corresponding chamber cover for said selected sock receiving chamber is disposed in an open position.

7. A sock separation device having multiple chambers corresponding to a predetermined number of users comprising:

a container having a plurality of ridge walls integrally joined to inner side walls of said container, said ridge walls forming substantially vertical ridge channels adjacent to said inner side walls of said container, said plurality of ridge walls engaging a lower portion of said inner side walls to form said substantially vertical ridge channels for receiving vertically disposed chamber walls to ultimately form a predetermined number of sock receiving chambers each having a chamber cover with an aperture to allow selected socks to be disposed in said corresponding sock receiving chamber;

a plurality of chamber walls inserted into corresponding ridge channels in said container via first and second side bottom edge portions of said lateral chamber walls being slidably and simultaneously inserted into cooperating vertical channels adjacent to inner longitudinal side walls of said container, said lateral chamber walls having a vertical joining slot in a top portion of said lateral chamber walls, said vertical joining slot in said top portion ultimately receiving a cooperating vertical joining slot in a bottom portion of a longitudinal chamber wall prior to said first and second side bottom edge portions of said longitudinal chamber wall being slidably inserted into cooperating vertical channels adjacent to inner lateral side walls of said container, said inserted lateral and longitudinal chamber walls forming a predetermined quantity of sock receiving chambers;

a plurality of chamber covers corresponding to said predetermined quantity of sock receiving chambers, each of said chamber covers having an aperture for allowing selected washed, dried socks to be disposed in a sock receiving chamber selected when an identified chamber cover for said selected sock receiving chamber is in a closed position, each of said sock chamber covers being identified via an identification element secured to a top wall of each chamber cover, such that all socks disposed in a respective sock receiving chamber via an aperture in an identified closed chamber cover are for a preselected user identified on a top wall of a closed chamber cover; and chamber cover pivot members secured to a predetermined edge portion for each of said chamber covers, said chamber cover pivot members for each chamber cover independently and cooperatively engaging a wall pivot member secured to a top edge portion of said longitudinal chamber wall, thereby enabling said chamber covers to independently pivot from a closed position to an open position, whereupon, the socks in a selected sock receiving chamber can be removed after a corresponding chamber cover for said selected sock receiving chamber is disposed in an open position.

8. A sock grouping and user identification device for socks comprising:

a container having a plurality of ridge walls integrally joined to inner side walls of said container, said ridge walls forming substantially vertical ridge channels adjacent to said inner side walls of said container, said plurality of ridge walls integrally joined to said inner side walls of said container engage a lower portion of said inner side walls to form said substantially vertical ridge channels for receiving vertically disposed chamber walls to ultimately form a predetermined number of sock receiving chambers each having a chamber cover with an aperture to allow selected socks to be disposed in said corresponding sock receiving chamber, said substantially vertical ridge channels extending from a top portion of said inner side walls of said container to a bottom portion of said inner walls of said container, thereby providing multiple vertical channels adjacent to said inner wall of said container, resulting in increased stability for maintaining the position of said chamber walls inserted into said ridge channels relative to said inner container walls, said container including a peripheral chamber bottom wall recess in a bottom inner wall that receives bottom edges of cooperating vertically orientated longitudinal and lateral chamber walls, thereby maintaining the position of said bottom edges of said longitudinal and lateral chamber walls relative to said inner side walls of said container, irrespective of the quantity of socks disposed in each sock receiving chamber;

at least one chamber wall removably inserted into a selected ridge channel in said container, said at least one chamber wall forming at least two sock receiving chambers;

at least two chamber covers, each of said chamber covers having an aperture to allow selected socks to be disposed in a selected sock receiving chamber when said selected chamber cover is in a closed position, said selected sock receiving chamber being identified such that all socks disposed in said respective chamber are for the use of a predetermined user; and chamber cover pivot members secured to predetermined edge portions of each of said chamber covers, said chamber cover pivot members for each chamber cover independently and cooperatively engaging a wall pivot member secured to a top edge portion of a longitudinal chamber wall, thereby enabling said chamber covers to independently pivot from a closed position to an open position, whereupon, the socks in a selected sock receiving chamber can be manually removed after a corresponding chamber cover for said selected sock receiving chamber is disposed in an open position.

9. The sock separation device of claim 8 wherein said container includes a lower portion having a substantially horizontal planar shelf wall formed into the periphery of said inner side walls of said container such that said shelf wall engages lower and relatively thicker first and second side edge portions of said chamber walls when compared to first and second side bottom edge portions of said chamber walls, thereby stabilizing said relatively thinner first and second side bottom edge portions of said chamber walls when said first and second side bottom edge portions of said chamber walls are snugly inserted into said cooperating vertical channels adjacent to said side inner side walls of said container, resulting in the positions of said chamber walls being maintained irrespective of the quantity of socks disposed in each sock receiving chamber.

10. The sock separation device of claim 9 wherein said container includes a peripheral chamber wall recess in said inner bottom wall of said container, said chamber wall recess having an arcuate configuration that cooperates with an arcuate bottom edge portion of said chamber walls to maintain the position of said chamber walls relative to said inner bottom wall of said container.

11. The sock separation device of claim 10 wherein said longitudinal chamber wall includes at least one vertical joining slot in a bottom portion of said longitudinal chamber wall.

12. The sock separation device of claim 11 wherein said vertical joining slot in said bottom portion of said longitudinal chamber wall includes a longitudinal dimension of substantially half the lateral dimension of said longitudinal chamber wall.

13. The sock separation device of claim 12 wherein said first and second side bottom edge portions of said longitudinal chamber wall are slidably and simultaneously inserted into cooperating vertical channels adjacent to inner lateral side walls of said container.

14. The sock separation device of claim 9 wherein said lateral chamber walls include at least one vertical joining slot in a top portion of said lateral chamber walls.

15. The sock separation device of claim 14 wherein said vertical joining slot in said top portion of said lateral chamber wall includes a longitudinal dimension of substantially half the lateral dimension of said lateral chamber wall.

16. The sock separation device of claim 15 wherein said left and right side bottom edge portions of said lateral chamber walls are slidably and simultaneously inserted into cooperating vertical channels adjacent to inner longitudinal side walls of said container.

17. The sock separation device of claim 16 wherein said at least one vertical joining slot in said top portion of said lateral chamber walls includes a substantially "V" configured upper portion for promoting the insertion of said at least one vertical joining slot in said bottom portion of said longitudinal chamber wall into said at least one vertical joining slot in said top portion of said lateral chamber walls.

18. The sock separation device of claim 17 wherein lateral chamber wall includes a half-chamber lateral wall, resulting in a relatively larger chamber.

19. A sock grouping and user identification device for socks comprising:

a container having a plurality of ridge walls integrally joined to inner side walls of said container, said ridge walls forming substantially vertical ridge channels adjacent to said inner side walls of said container, said plurality of ridge walls integrally joined to said inner side walls of said container engage a lower portion of said inner side walls to form said substantially vertical ridge channels for receiving vertically disposed chamber walls to ultimately form a predetermined number of sock receiving chambers each having a chamber cover with an aperture to allow selected socks to be disposed in said corresponding sock receiving chamber, said substantially vertical ridge channels extending from a top portion of said inner side walls of said container to a bottom portion of said inner walls of said container, thereby providing multiple vertical channels adjacent to said inner wall of said container, resulting in increased stability for maintaining the position of said chamber walls inserted into said ridge channels relative to said inner container walls;

at least one chamber wall removably inserted into a selected ridge channel in said container, said at least one chamber wall forming at least two sock receiving chambers;

at least two chamber covers, each of said chamber covers having an aperture to allow selected socks to be disposed in a selected sock receiving chamber when said selected chamber cover is in a closed position, said selected sock receiving chamber being identified such that all socks disposed in said respective chamber are for the use of a predetermined user; and chamber cover pivot members secured to predetermined edge portions of each of said chamber covers, said chamber cover pivot members for each chamber cover independently and cooperatively engaging a wall pivot member secured to a top edge portion of a longitudinal chamber wall, said wall pivot member including a pivot rod elevated above and parallel to said top edge portion of said longitudinal chamber wall, said pivot rod being elevated via elevating ribs a distance above said top edge portion of said longitudinal chamber wall that enables said chamber cover pivot members to snugly engage and rotate about said pivot rod without engaging said top edge portion of said longitudinal chamber wall, thereby enabling said chamber covers to independently pivot from a closed position to an open position, whereupon, the socks in a selected sock receiving chamber can be manually removed after a corresponding chamber cover for said selected sock receiving chamber is disposed in an open position.

20. The sock separation device of claim 19 wherein said elevating ribs are horizontally separated a distance that allows said chamber cover pivot members to snugly insert between adjacently disposed elevating ribs such that said chamber cover pivot members are allowed to pivot upon said pivot rod without obstruction from said elevating ribs.

* * * * *